US008837767B2

(12) United States Patent
Stewart et al.

(10) Patent No.: US 8,837,767 B2
(45) Date of Patent: Sep. 16, 2014

(54) LOUDSPEAKER SYSTEM

(71) Applicant: RGB Systems, Inc., Anaheim, CA (US)

(72) Inventors: William C Stewart, Raleigh, NC (US); Jeff Hatley, Mebane, NC (US); Michael Hudson, Nashville, NC (US); Larry Frerichs, Raleigh, NC (US); Clinton Strong, Apex, NC (US); Wesley Trenholme-Pihl, Raleigh, NC (US)

(73) Assignee: RGB Systems, Inc., Anaheim, CA (US)

( * ) Notice: Subject to any disclaimer, the term of this patent is extended or adjusted under 35 U.S.C. 154(b) by 0 days.

(21) Appl. No.: 13/757,567

(22) Filed: Feb. 1, 2013

(65) Prior Publication Data

US 2014/0064534 A1 Mar. 6, 2014

Related U.S. Application Data

(63) Continuation-in-part of application No. 13/113,545, filed on May 23, 2011.

(60) Provisional application No. 61/601,959, filed on Feb. 22, 2012.

(51) Int. Cl.

| | |
|---|---|
| ***H04R 1/02*** | (2006.01) |
| ***H04R 1/20*** | (2006.01) |
| ***H04R 1/34*** | (2006.01) |
| *H04R 1/32* | (2006.01) |

(52) U.S. Cl.

CPC ..... *H04R 1/345* (2013.01); *H04R 1/323* (2013.01); *H04R 1/021* (2013.01); *H04R 2201/021* (2013.01); *H04R 1/026* (2013.01)

USPC ..... 381/386; 381/337; 381/339; 248/292.13

(58) Field of Classification Search

CPC ..... H04R 1/02; H04R 1/026; H04R 1/345; H04R 2201/021; F16C 11/106; F16M 11/14

USPC ..... 381/337, 339, 386, 387, 390, 395; 248/288.31, 292.13, 346.03, 349.1

See application file for complete search history.

(56) References Cited

U.S. PATENT DOCUMENTS

| | | | | |
|---|---|---|---|---|
| 4,811,406 | A | 3/1989 | Kawachi | |
| 4,984,278 | A * | 1/1991 | Frye et al. | 381/387 |

(Continued)

FOREIGN PATENT DOCUMENTS

| | | |
|---|---|---|
| WO | WO 02/19761 A2 | 3/2002 |

*Primary Examiner* — Jesse Elbin

(74) *Attorney, Agent, or Firm* — The Hecker Law Group, PLC

(57) ABSTRACT

The present invention comprises a loudspeaker system that includes a loudspeaker and a detachable mount. In one or more embodiments, the loudspeaker and mount include electrical connectors that are engaged when the loudspeaker is attached to the mount. In one or more embodiments, the loudspeaker and mount comprise mating mounting structures that support the loudspeaker on the mount when the mounting structure of the loudspeaker is engaged with the mounting structure of the mount. In one or more embodiments, multiple configurations of the mount are provided that allow the loudspeaker to be mounted with a variety of orientations with respect to the mounting surface. In one or more embodiments, the loudspeaker comprises a tweeter with a rotatable wave guide that allows the dispersion angle of the tweeter to be adjusted to accommodate the variety of orientations at which the loudspeaker may be mounted.

9 Claims, 46 Drawing Sheets

(56) References Cited

U.S. PATENT DOCUMENTS

| | | | | |
|---|---|---|---|---|
| 5,704,578 | A | 1/1998 | Fischer | |
| 5,859,917 | A * | 1/1999 | Silber et al. | 381/386 |
| 6,070,694 | A | 6/2000 | Burdett et al. | |
| 7,455,271 | B2 * | 11/2008 | Pincek et al. | 381/386 |
| 2003/0044039 | A1 | 3/2003 | Sterns et al. | |
| 2003/0174855 | A1 | 9/2003 | Hawkins et al. | |
| 2009/0214067 | A1 * | 8/2009 | Bothe | 381/339 |
| 2010/0054522 | A1 | 3/2010 | Maurer et al. | |
| 2010/0322457 | A1 | 12/2010 | Gladwin et al. | |

* cited by examiner

LOUDSPEAKER SYSTEM

CROSS-REFERENCE TO RELATED PATENT APPLICATIONS

This patent claims the benefit of the filing date of U.S. Provisional Patent Application Ser. No. 61/601,959 for "Loudspeaker System" filed on Feb. 22, 2012 and is a continuation in part of U.S. patent application Ser. No. 13/113,545 for "Loudspeaker System" filed on May 23, 2011, both of which are incorporated by reference in their entireties herein.

BACKGROUND OF THE INVENTION (1) Field of the Invention

The present invention relates to a loudspeaker system comprising a loudspeaker and a detachable mount.

(2) Background of the Invention

It is often desired to mount loudspeakers to walls, ceilings, or other surfaces at locations that are remote from the source of the electrical audio signals that are to be emitted from the loudspeakers. For appearance purposes, it is desirable that the speaker wires connecting the loudspeakers to their audio source (such as, for example, an amplifier or surround-sound system) are not visible. One way to achieve such invisibility is to run the speaker wires through walls. In some cases, structured wiring systems may have been installed in a building's walls that can be used to transmit the audio from the source to the speakers. In other cases, in-wall wiring can be retrofitted to a building.

In-wall wiring typically terminates at an electrical junction box that is accessible through a corresponding opening that is created in the wall material. A wall plate is typically mounted to the electrical box to cover the wall opening. For speaker wire applications, the wall plate typically includes connectors on the outside of the plate that are electrically connected to the in-wall wires. Typical connectors include banana plugs, spring clips, and screw terminals. Wires are typically run from the wall plate connectors to terminals on the loudspeaker housing. Accordingly, although the bulk of the wiring from the audio source to the loudspeakers may be hidden inside the walls, the portions running from the wall plate to the loudspeaker remain visible. Further, if it is desired to mount the loudspeaker on a wall or other surface, several steps must be performed: a loudspeaker mount must be attached to the wall, the loudspeaker must be attached to the mount, and wires must be run from the wall plate to the loudspeaker.

It is desirable to have a loudspeaker system that allows convenient and secure mounting of the loudspeaker to a wall plate and that eliminates unsightly exposed speaker wires.

BRIEF SUMMARY OF THE INVENTION

The present invention comprises a loudspeaker system that includes a loudspeaker and a detachable mount. In one or more embodiments, the loudspeaker and mount include electrical connectors that are engaged when the loudspeaker is attached to the mount. In one or more embodiments, the loudspeaker and mount comprise mating mounting structures that support the loudspeaker on the mount when the mounting structure of the loudspeaker is engaged with the mounting structure of the mount. In one or more embodiments, mating electrical connectors are incorporated in the mounting structures such that engaging the mounting structures simultaneously engages the electrical connectors. In one or more embodiments, the loudspeaker comprises a locking mechanism that positively retains the loudspeaker on the mount. In one or more embodiments, the locking mechanism is hidden behind a flexible grill of the loudspeaker such that pressing on a corresponding location on the grill releases the locking mechanism allowing the loudspeaker to be detached from the mount. In one or more embodiments, the mount is configured to be mountable to a standard US or European electrical wiring box. In one or more embodiments, the mating mounting structures are configured to be engageable with a reduced amount of travel. In one or more embodiments, multiple configurations of the mount are provided that allow the loudspeaker to be mounted with a variety of orientations with respect to the mounting surface. In one or more embodiments, the loudspeaker comprises a tweeter with a rotatable wave guide that allows the dispersion angle of the tweeter to be adjusted to accommodate the variety of orientations at which the loudspeaker may be mounted.

BRIEF DESCRIPTION OF THE DRAWINGS

The present invention may be understood and its features made apparent to those skilled in the art by referencing the accompanying drawings.

DETAILED DESCRIPTION OF THE INVENTION

Figure 1:
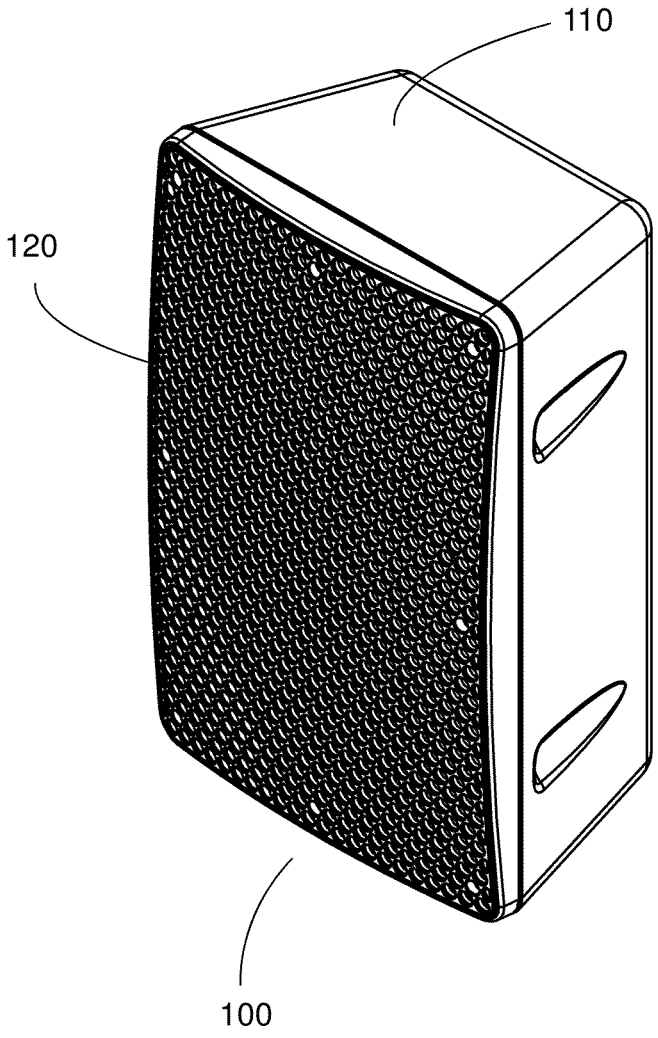
FIG. 1 is a perspective view of an embodiment of a loudspeaker of the present invention.
Figure 2:
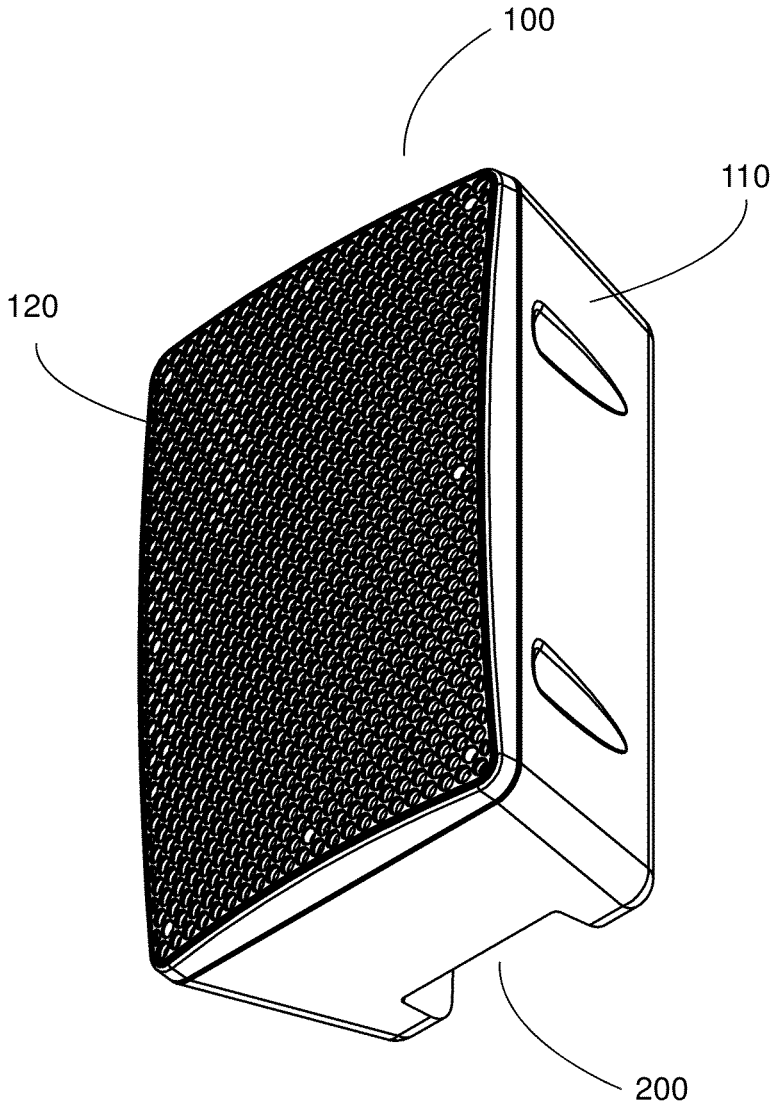
FIG. 2 is a perspective view of an embodiment of a loudspeaker of the present invention.
Figure 3:
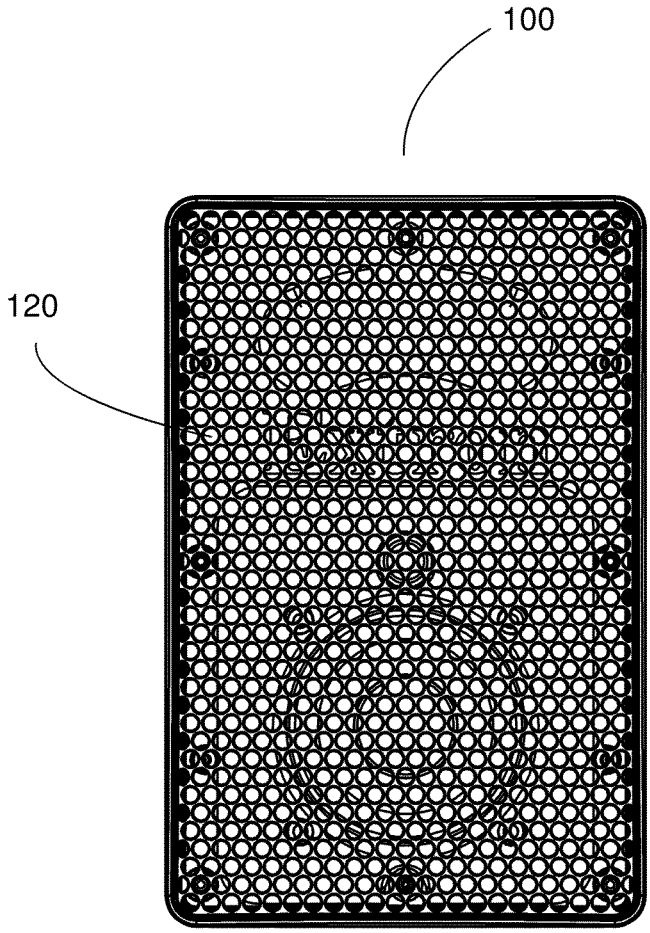
FIG. 3 is a front view of an embodiment of a loudspeaker of the present invention.
Figure 4:
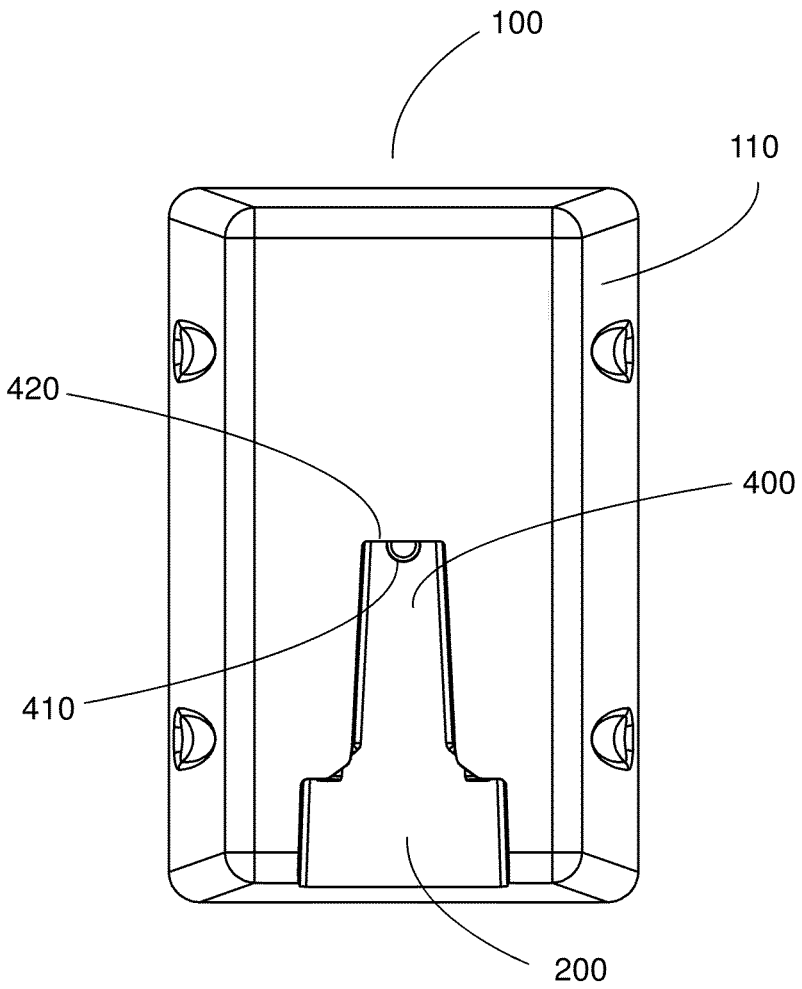
FIG. 4 is a rear view of an embodiment of a loudspeaker of the present invention.
Figure 5:
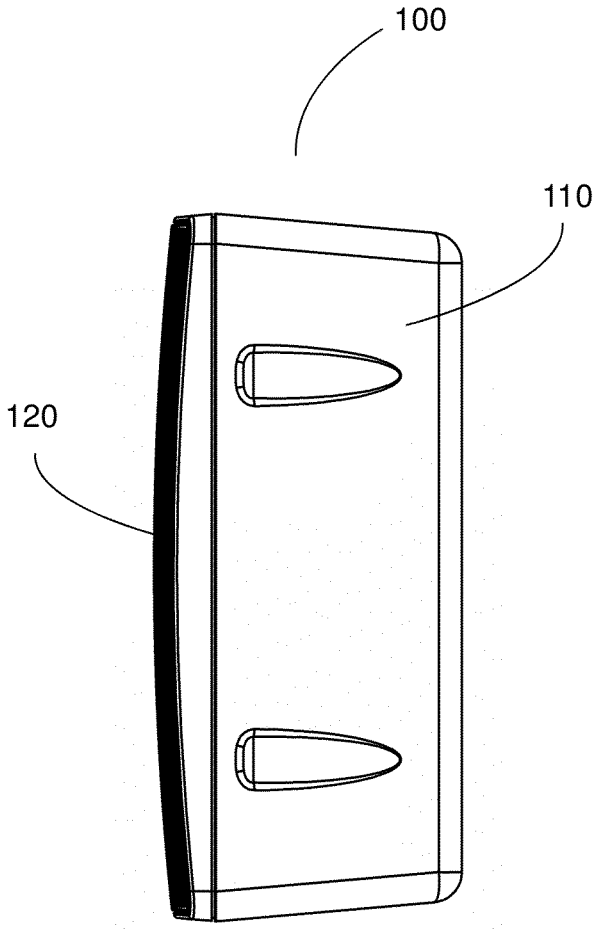
FIG. 5 is a side view of an embodiment of a loudspeaker of the present invention.
Figure 6:
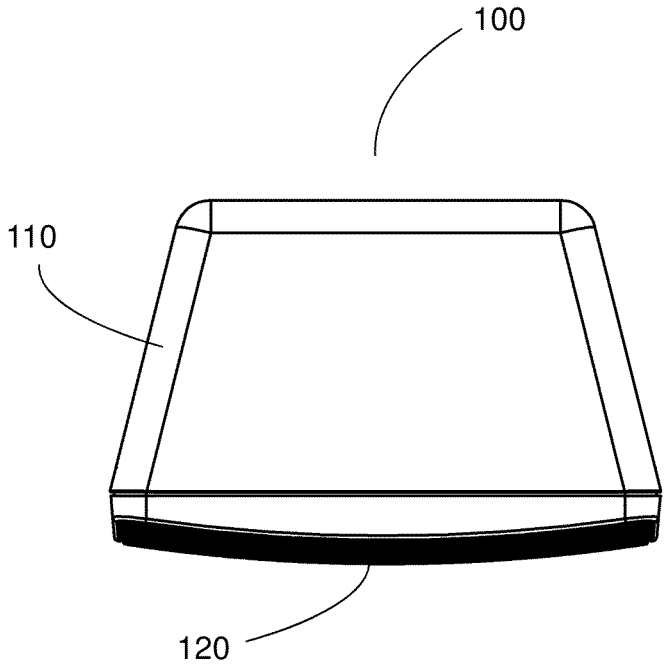
FIG. 6 is a top view of an embodiment of a loudspeaker of the present invention.
Figure 7:
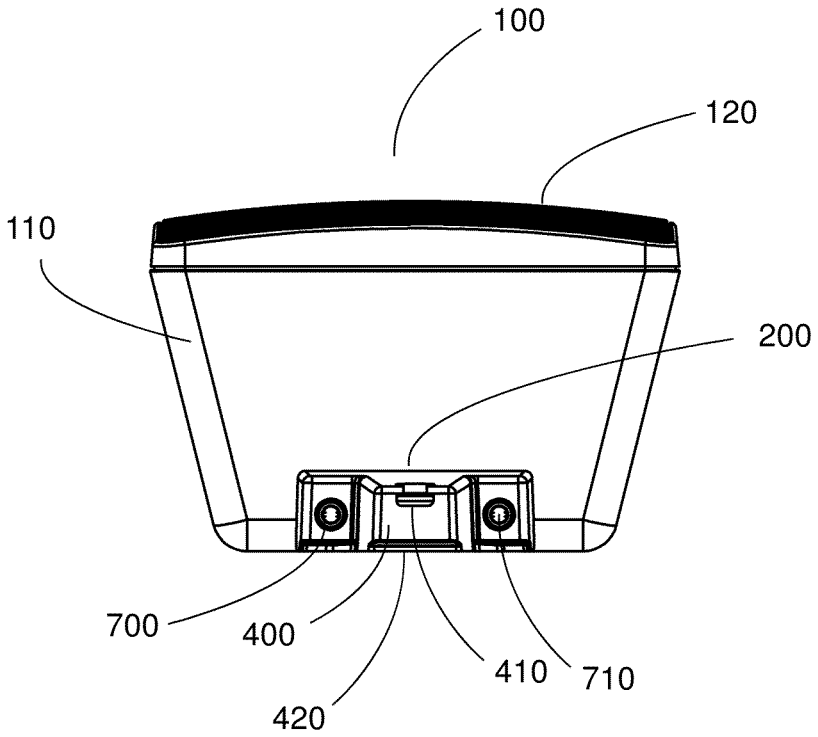
FIG. 7 is a bottom view of an embodiment of a loudspeaker of the present invention.

FIGS. 1 to 7 illustrate a loudspeaker 100 in accordance with one or more embodiments of the invention. In the embodiment shown in FIG. 1, loudspeaker 100 includes a speaker housing 110 and a grille 120. Speaker housing 110 and grille 120, as well as the internal structure and configuration of loudspeaker 100, are not critical and can be of any form, shape, and material as may be known in the art. In the embodiment shown in FIG. 2, housing 110 includes a recessed mounting channel 200 that is part of a mounting structure for mounting loudspeaker 100 to a mating speaker mount. In the embodiment shown in FIG. 4, mounting channel 200 includes a channel neck 400, a locking pin 410, and a mounting lip 420. In the embodiment shown in FIG. 7, mounting channel 200 includes conducting elements 700 and 710 that are configured to engage and provide electrical contact to corresponding conducting elements in a mating speaker mount.

FIGS. 8 to 13 illustrate a speaker mount 800 in accordance with one or more embodiments of the invention. In one or more embodiments, speaker mount 800 is configured to attach to loudspeaker 100 and to a standard electrical junction box (not shown). In the embodiment shown in FIG. 8, speaker mount 800 includes a rear portion 805 and a mounting structure portion extending outwards from rear portion 805 that includes a lower support portion 820 and an upper support portion 810. Lower support portion 820 and upper support portion 810 are configured to engage, for example, recessed mounting channel 200 of loudspeaker 100. In the embodiment shown in FIG. 8, upper support portion 810 includes a slot 840 that is configured to accept locking pin 410 of loudspeaker 100 when loudspeaker 100 is mounted to speaker mount 800. In one or more embodiments, slot 840 includes a locking recess 850 that positively engages the head of locking pin 410 when loudspeaker 100 is fully seated on speaker mount 800. In the embodiment shown in FIG. 8, lower support portion 820 includes socket portions 830 and 835 that contain conducting elements that are configured to mate with conducting elements 700 and 710 of loudspeaker 100 when loudspeaker 100 is mounted to speaker mount 800.

Figure 9:
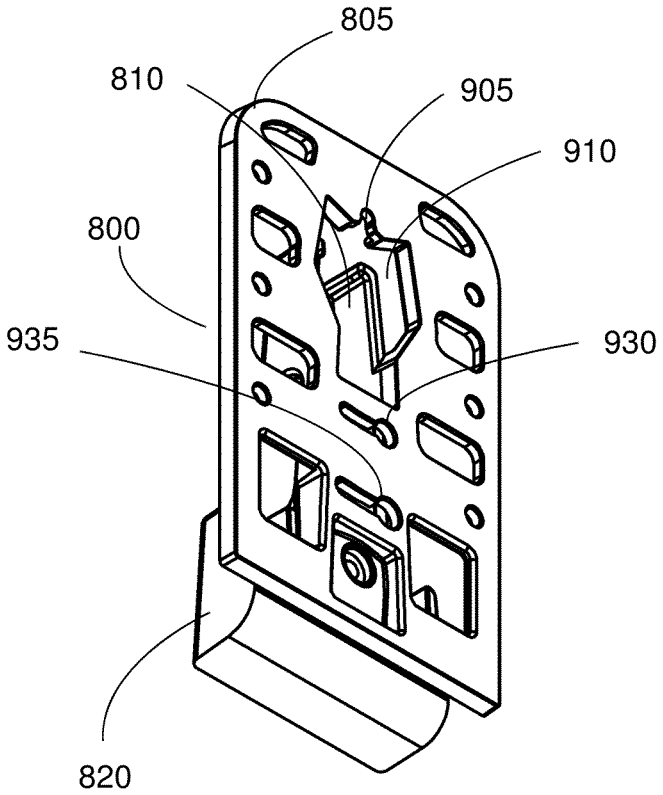
FIG. 9 is a perspective view of an embodiment of a speaker mount of the present invention.
Figure 10:
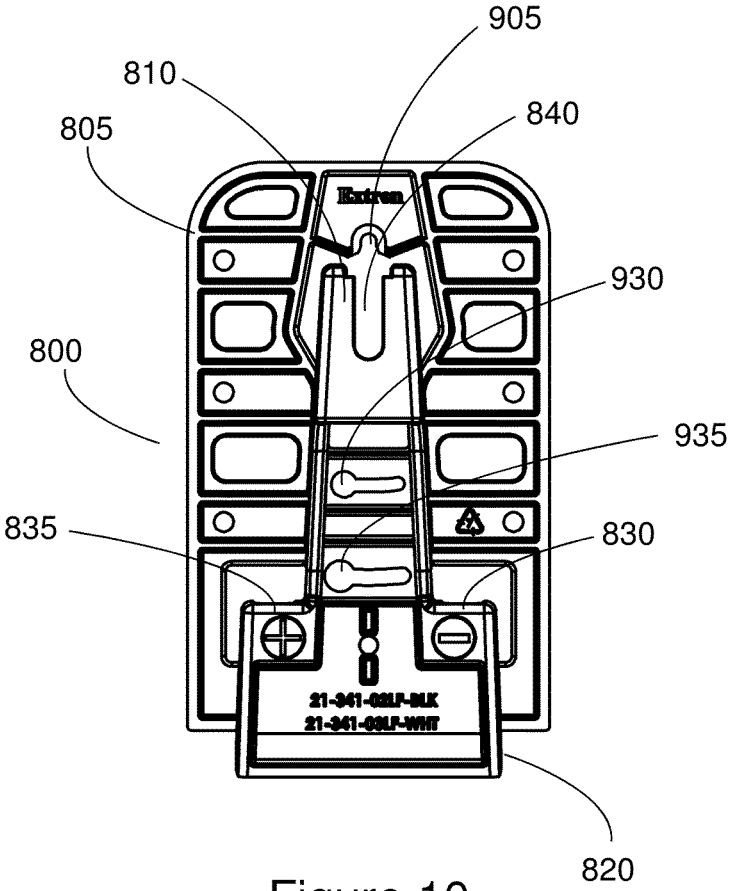
FIG. 10 is a front view of an embodiment of a speaker mount of the present invention.

In the embodiments shown in FIGS. 9 and 10, rear portion 805 of speaker mount 800 includes a number of orifices. Those orifices include an upper orifice 910 that includes an upper screw recess 905 and lower screw orifices 930 and 935. In one or more embodiments, lower screw orifices 930 and 935 are configured as slots that allow a degree of positional adjustment of speaker mount 800 with respect to an electrical junction box to which speaker mount 800 is mounted. In one or more embodiments, upper screw orifice 905 and lower screw orifice 930 are configured to correspond to the spacing of cover plate attachment screws for a first size of a standard electrical junction box (e.g. a standard metric electrical junction box that has 60 mm attachment screw spacing), while upper screw recess 905 and lower screw orifice 935 are configured to correspond to the spacing of cover plate attachment screws for a second size of a standard electrical junction box (e.g. a standard U.S. electrical junction box that has 3.25 inch attachment screw spacing).

Figure 11:
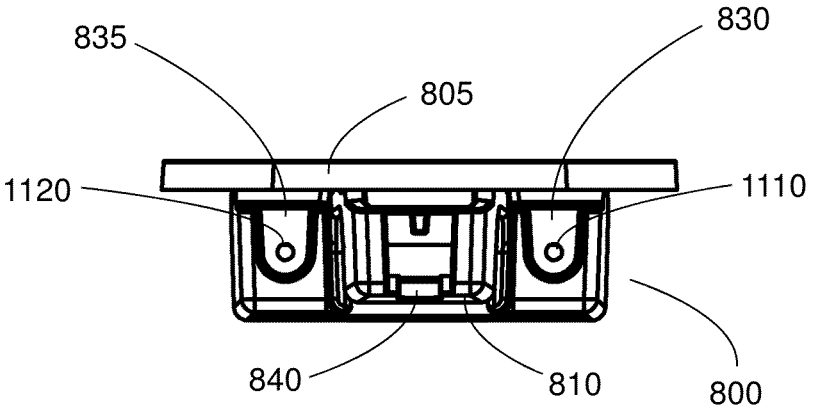
FIG. 11 is a top view of an embodiment of a speaker mount of the present invention.
Figure 12:
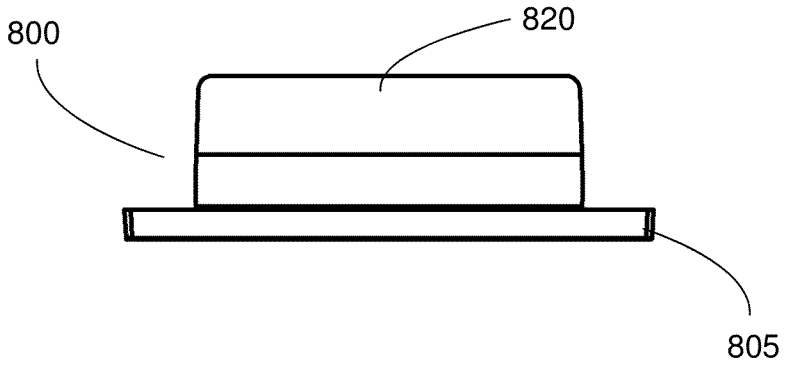
FIG. 12 is a bottom view of an embodiment of a speaker mount of the present invention.

In the embodiment shown in FIG. 11, socket portions 830 and 835 of speaker mount 800 include conducting elements 1110 and 1120 that are configured to engage conducting elements 700 and 710 of loudspeaker 100 when loudspeaker 100 is mounted to speaker mount 800. Conducting elements 700, 710, 1110 and 1120 can be any type of mating conducting elements. In one or more embodiments, conducting elements 700, 710, 1110 and 1120 comprise standard electrical connectors, for example, mating pin and socket Molex connectors.

Figure 13:
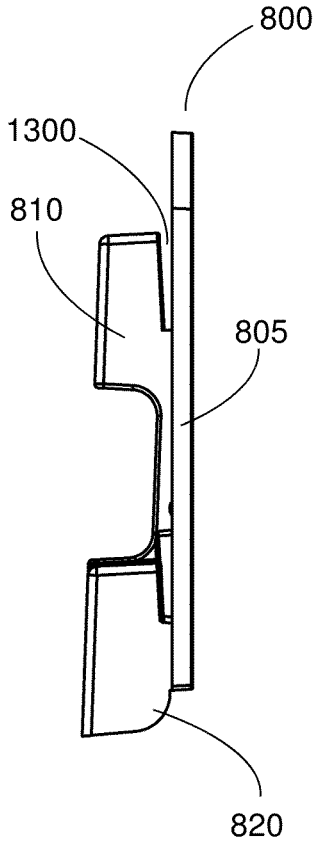
FIG. 13 is a side view of an embodiment of a speaker mount of the present invention.
Figure 14:
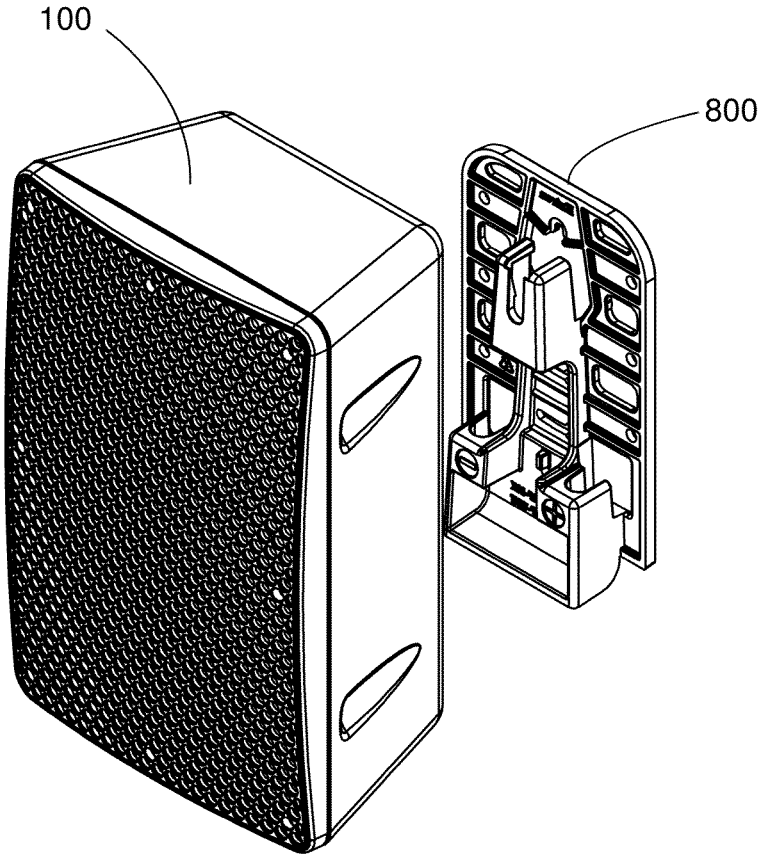
FIG. 14 is a perspective view of an embodiment of a loudspeaker and a speaker mount of the present invention.

In the embodiment shown in FIG. 13, upper support portion 810 of speaker mount 800 includes a tapered gap 1300 between upper support portion 810 and rear portion 805. In one or more embodiments, gap 1300 is configured to accept mounting lip 420 of loudspeaker 100 when loudspeaker 100 is mounted to speaker mount 800.

Figure 15A:
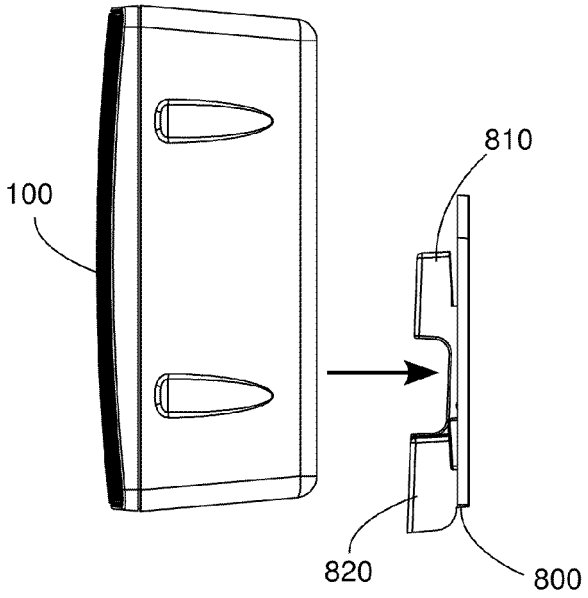
FIG. 15*a* is a side view of an embodiment of a loudspeaker and a speaker mount of the present invention.
Figure 15B:
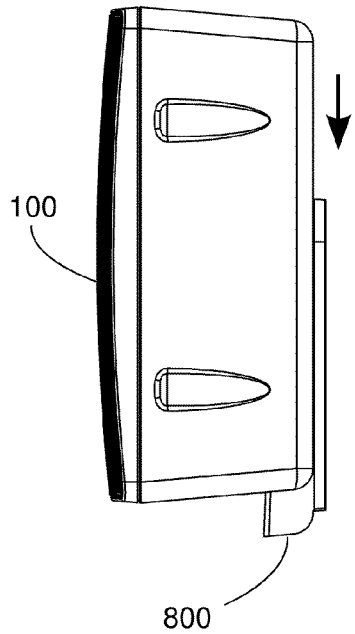
FIG. 15*b* is a side view of an embodiment of a loudspeaker and a speaker mount of the present invention.
Figure 15C:
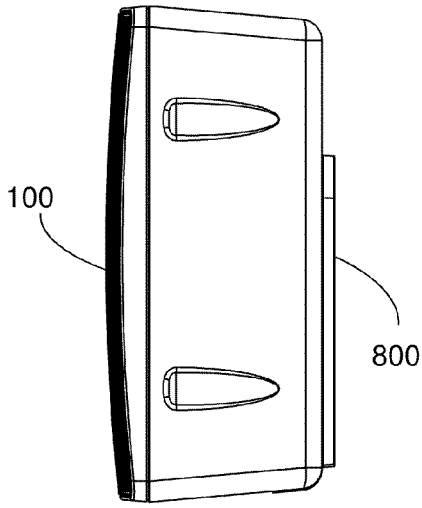
FIG. 15*c* is a side view of an embodiment of a loudspeaker and a speaker mount of the present invention.
Figure 16:
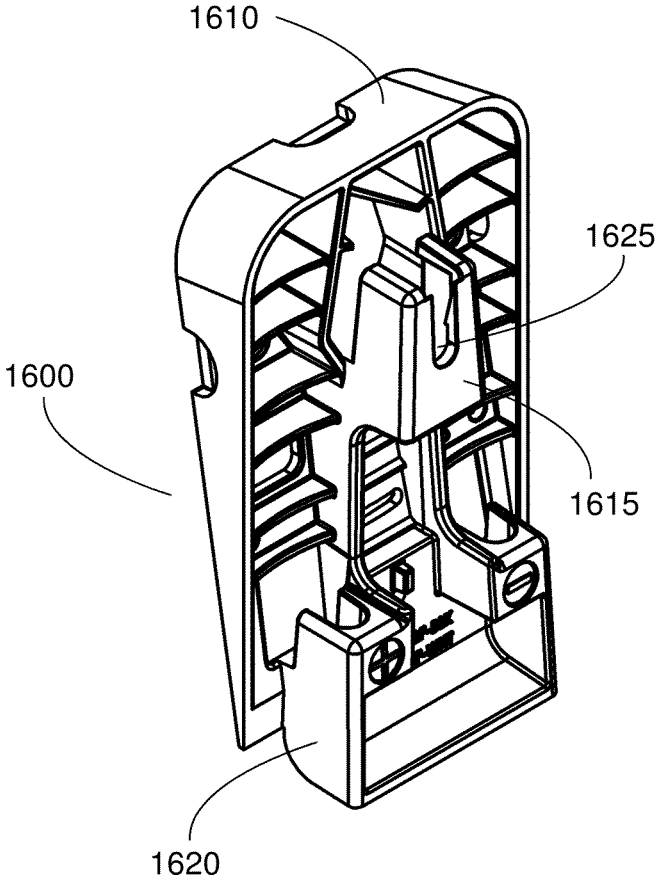
FIG. 16 is a perspective view of an embodiment of a speaker mount of the present invention.

FIGS. 14 and 15*a*, 15*b* and 15*c* illustrate how loudspeaker 100 is mounted to speaker mount 800 according to one or more embodiments of the invention. In the embodiment shown in FIG. 15*a*, loudspeaker 100 is lined up such that the top of upper support portion 810 of speaker mount 800 is below mounting lip 420 of mounting channel 200 of loudspeaker 100 such that upper and lower support portions 810 and 820 of speaker mount 800 engage mounting channel 200 of loudspeaker 100 when loudspeaker 100 is moved horizontally towards speaker mount 800. In the embodiment shown in FIG. 15*b*, once loudspeaker 100 is positioned such that upper and lower support portions 810 and 820 of speaker mount 800 are engaged within mounting channel 200 of speaker mount 800, loudspeaker 100 is moved vertically downwards with respect to speaker mount 800 until loudspeaker 100 is fully seated on speaker mount 800, as shown in FIG. 15*c*. As is apparent from FIG. 15*c*, because mounting channel 200 is recessed into the housing of loudspeaker 100, when loudspeaker 100 is seated on speaker mount 800, there is only a small separation between the rear of loudspeaker 100 and the mounting surface. Having such a recessed mounting channel allows loudspeaker 100 to be mounted close to the mounting surface, such that the distance that the front of loudspeaker 100 extends from the mounting surface is not much more than the depth of loudspeaker 100 itself, thereby facilitating compliance with building codes (such as, for example, the Americans with Disabilities Act) that limit the distance that objects may extend outwards from inside building walls.

In one or more embodiments, when loudspeaker 100 is fully seated on speaker mount 800, mounting lip 420 of mounting channel 200 of loudspeaker 100 is seated in tapered gap 1300 of speaker mount 800, locking pin 410 of loudspeaker 100 engages locking recess 850 of slot 840 of speaker mount 800, and conducting elements 700 and 710 of loudspeaker 100 are in electrical contact with conducting elements 1110 and 1120 of speaker mount 800. In one or more embodiments, mounting channel 200 of loudspeaker 100 and upper and lower support portions 810 and 820 of speaker mount 800 are configured such that the amount of vertical travel needed for loudspeaker 100 to engage speaker mount 800 (and hence the minimum clearance required above loudspeaker 100 when mounted to speaker mount 800) is approximately an inch.

Figure 22:
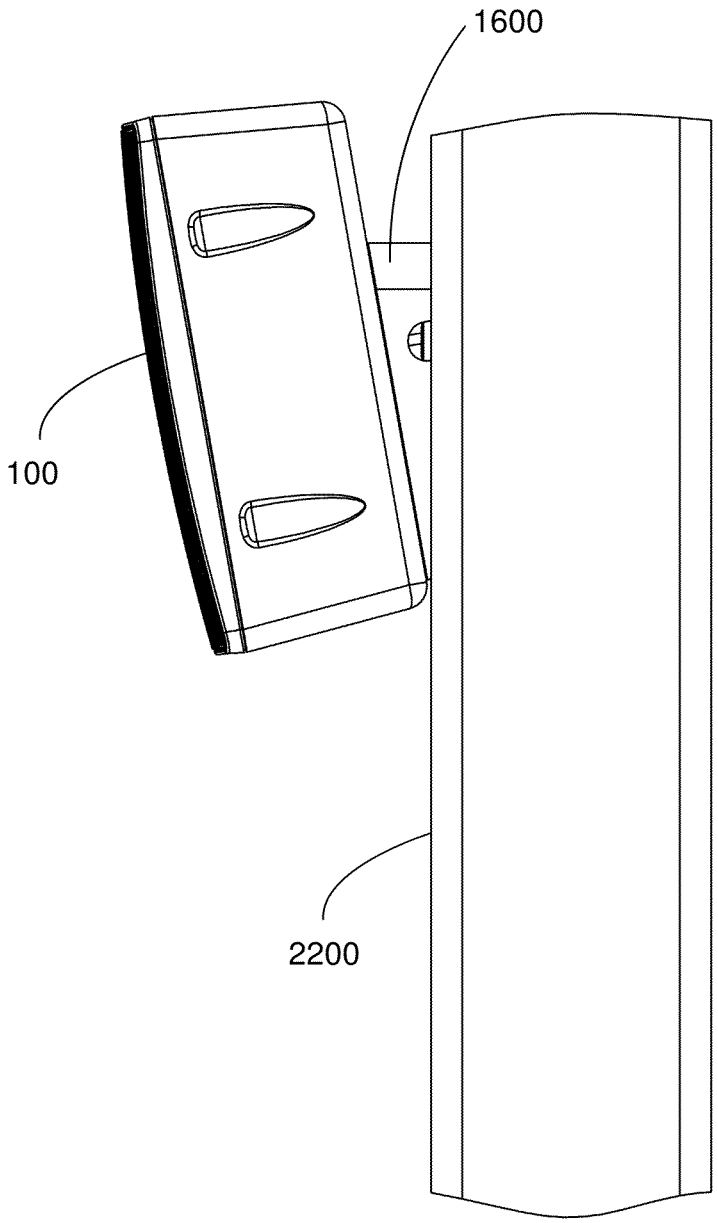
FIG. 22 is a side view of an embodiment of a loudspeaker and a speaker mount of the present invention.

FIGS. 16 to 21 show an embodiment of an angled speaker mount 1600 of the invention. In one or more embodiments, angled speaker mount 1600 is configured to maintain a loudspeaker at an angle with respect to the mounting surface, such as a wall. In the embodiment shown in FIGS. 16 to 21, angled speaker mount 1600 is configured to maintain loudspeaker 100 at an angle of approximately 10 degrees with respect to a mounting surface, as shown, for example, in FIG. 22. However, angled speaker mount 1600 can be configured to maintain loudspeaker 100 at any other angle. In one or more embodiments, angled speaker mount 1600 is configured to allow the angle of loudspeaker 100 to be varied by incorporating, for example, a hinged plate, or by use of adapter plates each of which increases the angle by a specified amount.

Figure 17:
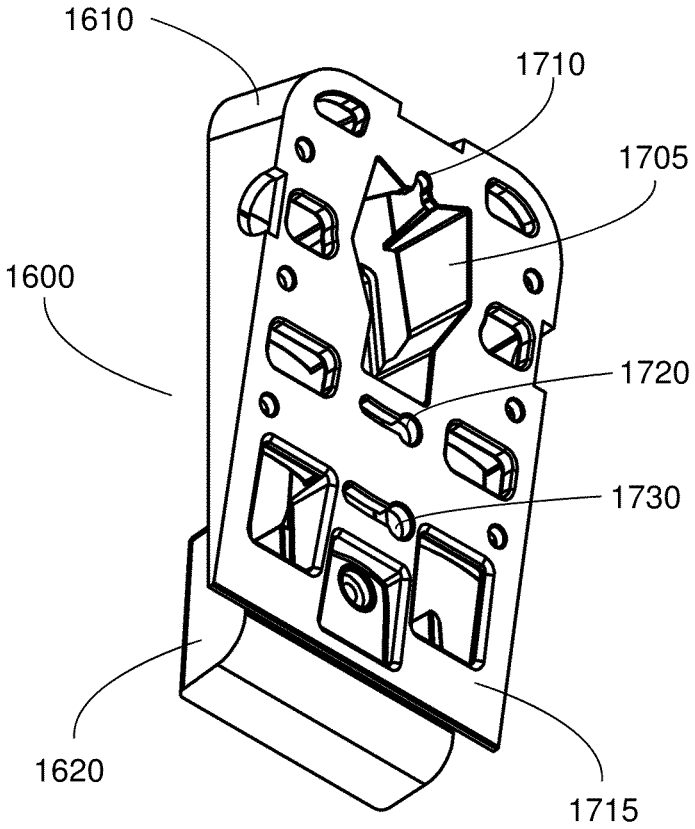
FIG. 17 is a perspective view of an embodiment of a speaker mount of the present invention.
Figure 18:
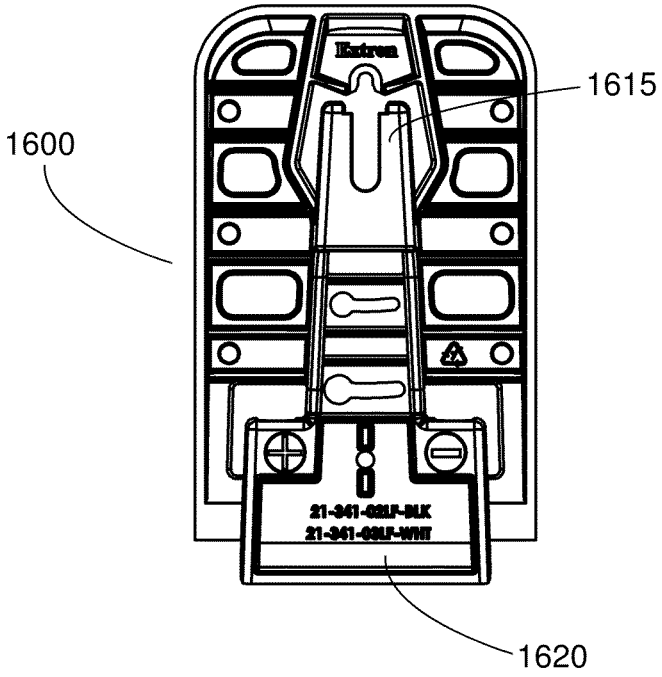
FIG. 18 is a front view of an embodiment of a speaker mount of the present invention.
Figure 19:
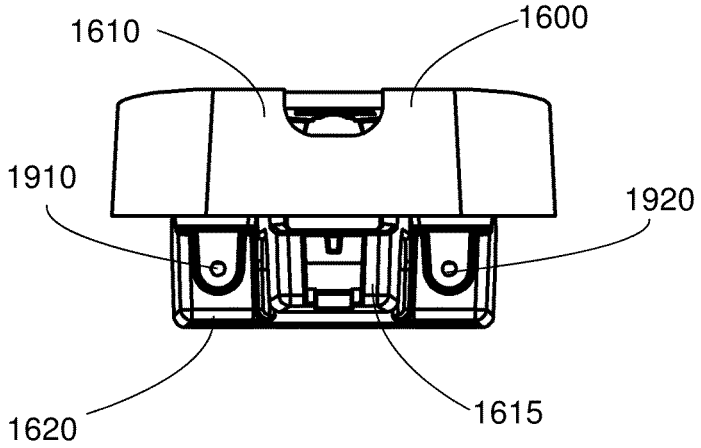
FIG. 19 is a top view of an embodiment of a speaker mount of the present invention.
Figure 20:
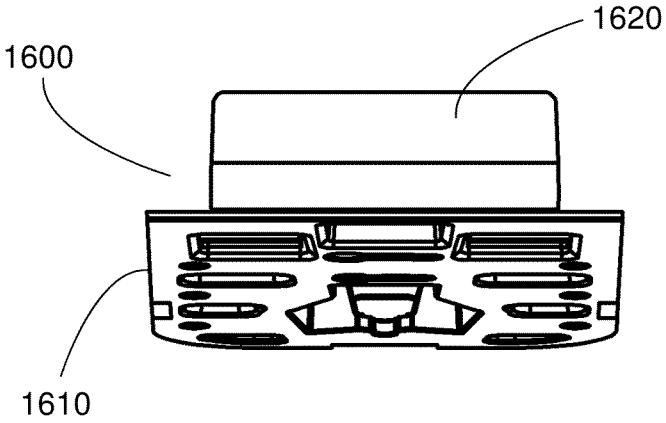
FIG. 20 is a bottom view of an embodiment of a speaker mount of the present invention.
Figure 21:
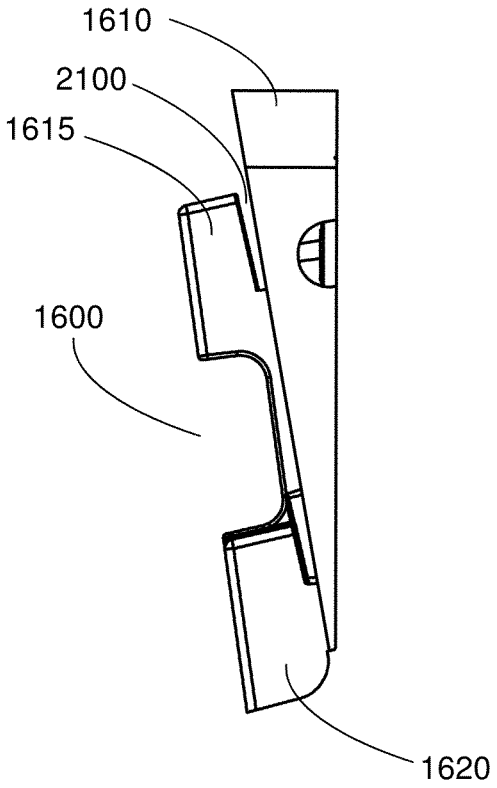
FIG. 21 is a side view of an embodiment of a speaker mount of the present invention.

In the embodiments shown in FIGS. 16 to 21, angled speaker mount 1600 includes a wedge-shaped rear portion 1610 and upper and lower support portions 1615 and 1620. Wedge-shaped rear portion 1610 maintains upper and lower support portions 1615 and 1620, respectively, at an angle with respect to a mounting surface. Upper and lower support portions 1615 and 1620 have the same general configuration as upper and lower support portions 810 and 820 of speaker mount 800, and are configured to engage mounting channel 200 of loudspeaker 100, and mount to loudspeaker 100, in the same manner as speaker mount 800. As shown in FIG. 17, in one or more embodiments, wedge-shaped rear portion 1610 comprises a number of orifices on rear mounting face 1715. In one or more embodiments, the orifices include an upper orifice 1705 comprising an upper screw orifice 1710 and lower screw orifices 1720 and 1730, which have the same general configuration as upper orifice 910, upper screw orifice 905, and lower screw orifices 930 and 935 of speaker mount 800 of FIG. 9. In the embodiment shown in FIG. 21, angled speaker mount 1600, like speaker mount 800 shown in FIG. 13, includes a tapered slot 2100 for engaging mounting lip 420 of loudspeaker 100 when loudspeaker 100 is seated on angled speaker mount 1600.

Figure 23:
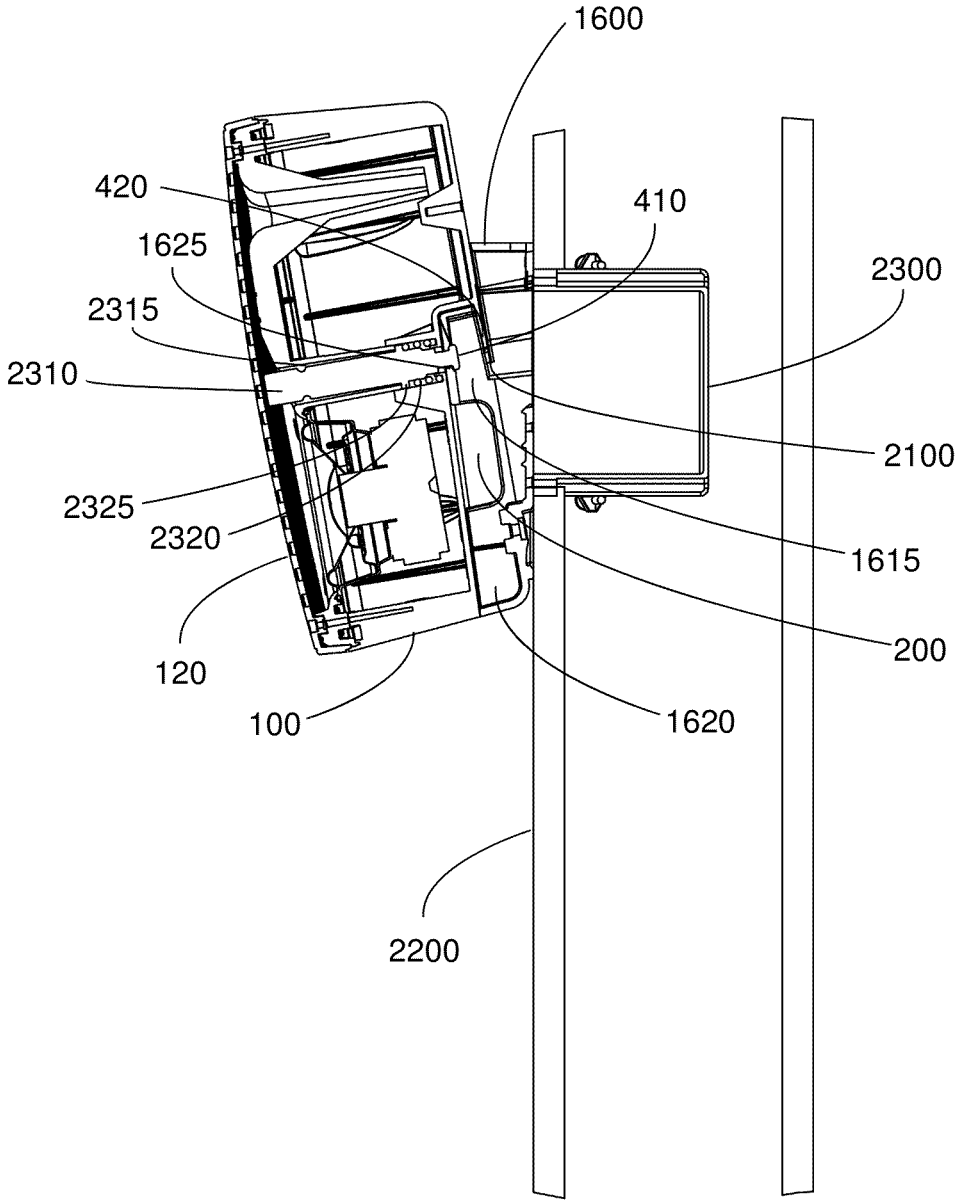
FIG. 23 is a sectional side view of an embodiment of a loudspeaker and a speaker mount of the present invention.

FIG. 23 is a sectional view of an embodiment of speaker 100 mounted to an angled speaker mount 1600, which in turn is mounted to a junction box 2300 mounted in a wall 2200. As shown in FIG. 23, when speaker 100 is fully seated on angled speaker mount 1600, mounting lip 420 of loudspeaker 100 is disposed within tapered slot 2100 of angled speaker mount 1600, lower support portion 1620 of angled speaker mount 1600 is disposed in mounting channel 200 of loudspeaker 100, and locking pin 410 of loudspeaker 100 is engaged in locking recess 1625 of upper support portion 1615 of angled speaker mount 1600. In addition, conducting elements 700 and 710 of loudspeaker 100 are in electrical contact with conducting elements 1910 and 1920 of speaker mount 1600.

In the embodiment of FIG. 23, locking pin 410 is part of a locking mechanism that includes a plunger 2310 disposed in a channel 2315 formed in loudspeaker 100. The end of plunger 2310 opposite from locking pin 410 is disposed inside loudspeaker housing 110 behind grille 120 so that it is "hidden" in the sense that the locking mechanism is disposed behind grille 120. A spring 2320 (for example, a coil spring) that engages a shoulder 2325 on plunger 2310 biases plunger 2310 towards its recessed (retracted) position. In its retracted position, there is clearance between plunger 2310 and grille 120. In one or more embodiments, grille 120 is sufficiently flexible such that pressing on grille 120 adjacent to the position of plunger 2310 causes grille 120 to deform so as to contact and push plunger 2310 away from its retracted position against the bias exerted by spring 2320. If loudspeaker 100 is engaged on a speaker mount, pushing on grille 120 disengages locking pin 410 from the corresponding locking recess of the speaker mount, allowing loudspeaker 100 to be disengaged from the speaker mount. In one or more embodiments, grille 120 is formed from a flexible, resilient plastic material, which allows it to have a domed shape yet be sufficiently deformable so as to be able to contact and push plunger 2310 as described above and return to its original shape when released. In one or more embodiments, the grille is molded from a polycarbonate/ABS blend. However, any other materials capable of being formed into a grille may be used, as will be known to those of skill in the art. In one or more embodiments, the grille comprises a pattern of 3/16 inch diameter holes on staggered centers that provides approximately 51% of free area, and that is similar in appearance to grilles often used in ceiling vents.

Figure 24:
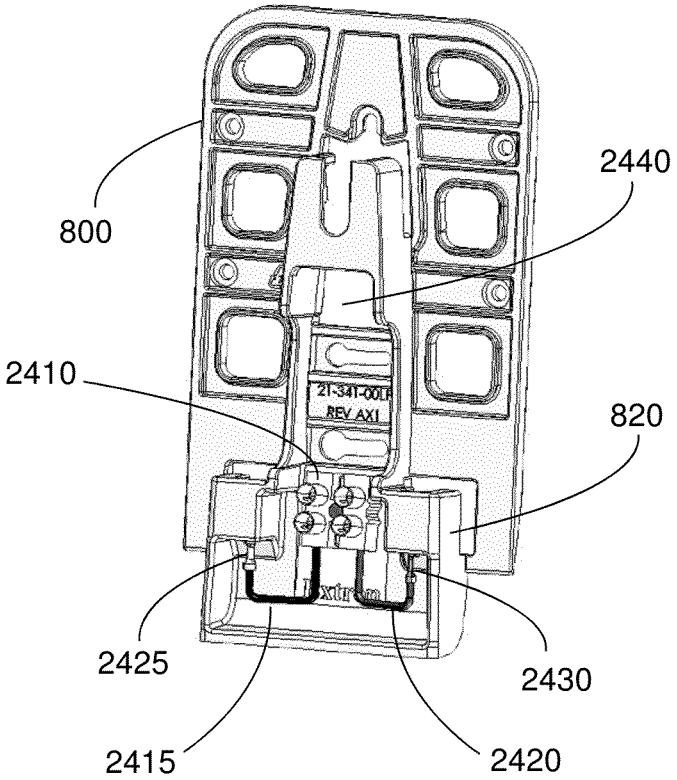
FIG. 24 is a perspective view of an embodiment of a speaker mount of the present invention.

FIG. 24 shows electrical connections for the speaker wires for a speaker mount 800 in one or more embodiments of the invention. In the embodiment of FIG. 24, a European type terminal block 2410 is attached to speaker mount 800, for example, by one or more screws or rivets. Two wires, 2415 and 2420, each with an electrical connector (for example a Molex™ or similar connector) 2425 and 2430, respectively, are connected to the lower two terminals of terminal block 2410. Electrical connectors 2425 and 2430 are inserted into corresponding holes in lower support portion 820, and lock into place by means of metal tab portions on the sides of the connectors, as is known in the art. When mounted to an electrical junction box, in-wall speaker wires may be threaded through orifice 2440 and connected to the upper two terminals of terminal block 2410, thereby creating an electrical connection to connectors 2425 and 2430, which contact corresponding electrical connectors of a loudspeaker 100 when loudspeaker 100 is mounted to speaker mount 800.

Figure 25:
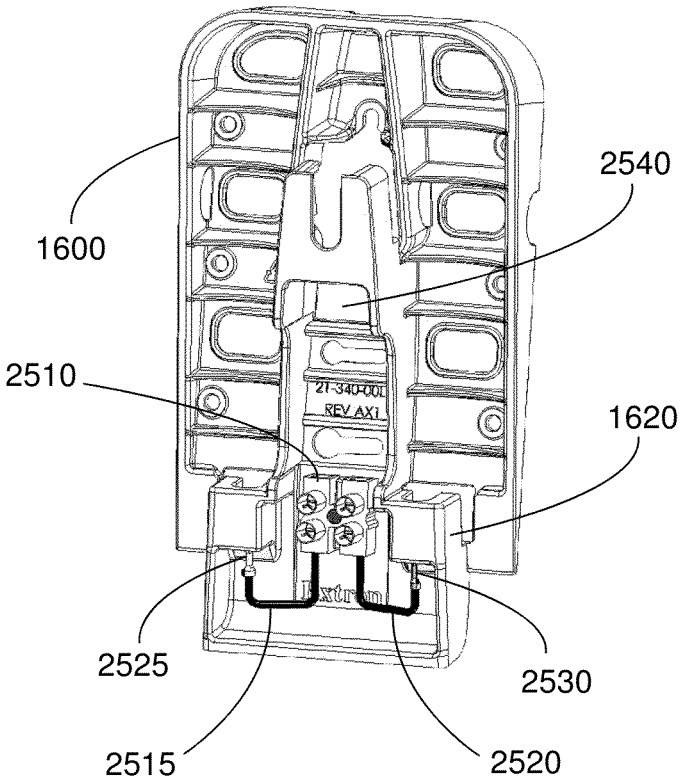
FIG. 25 is a perspective view of an embodiment of a speaker mount of the present invention.

FIG. 25 shows electrical connections for the speaker wires for an angled speaker mount 1600 in one or more embodiments of the invention. Like the embodiment of FIG. 24, in the embodiment of FIG. 25, a European type terminal block 2510 is attached to angled speaker mount 1600, for example, by one or more screws or rivets. Two wires, 2515 and 2520, each with an electrical connector (for example a Molex™ or similar connector) 2525 and 2530, respectively, are connected to the lower two terminals of terminal block 2510. Electrical connectors 2525 and 2530 are inserted into corresponding holes in lower support portion 1620, and lock into place by means of metal tab portions on the sides of the connectors, as is known in the art. When mounted to an electrical junction box, in-wall speaker wires may be threaded through orifice 2540 and connected to the upper two terminals of terminal block 2510, thereby creating an electrical connection to connectors 2525 and 2530, which contact corresponding electrical connectors of a loudspeaker 100 when loudspeaker 100 is mounted to speaker mount 800.

Figure 26:
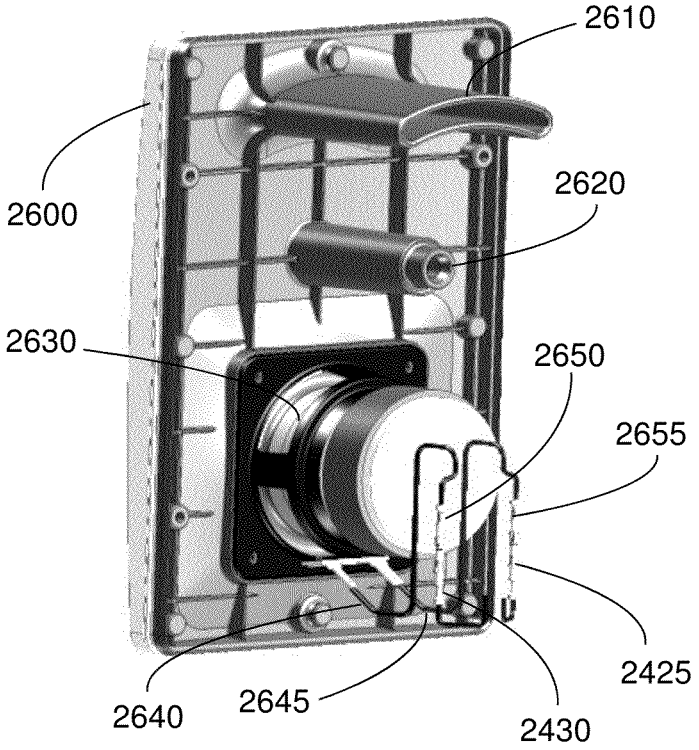
FIG. 26 is a cut-away view of an embodiment of a loudspeaker of the present invention.

FIG. 26 shows the internal wiring of a loudspeaker 100 according to one or more embodiments of the invention. In FIG. 26, the rear portion of housing 110 is not shown so that portions of the internal structure of loudspeaker 100 are visible. FIG. 26 shows a front portion 2600 of a speaker housing that includes a speaker port 2610, a locking plunger channel 2620, and a speaker driver 2630 mounted to front portion 2600. Speaker wires 2640 and 2645 are each attached to the electrical terminals of speaker driver 2630 at one end and to electrical connectors (for example Molex™ or similar connectors) 2650 and 2655, respectively, at the other end. In one or more embodiments, in an assembled loudspeaker 100, connectors 2650 and 2655 are inserted in corresponding holes in the rear housing portion (not shown) and lock into place by means of metal tab portions on the sides of the connectors, as is known in the art. In one or more embodiments, when installed in the rear housing portion, connectors 2650 and 2655 extend into mounting channel 200 such that they engage corresponding connectors 2430 and 2425 (shown in FIG. 26 disembodied from any speaker mount to help show their interaction with connectors 2650 and 2655) of a corresponding wall mount when loudspeaker 100 is mounted to the speaker mount, as described above.

Additional embodiments of the loudspeaker system of the invention are shown in FIGS. 27 to 46 and shown and described in Appendix 1, attached hereto.

Figure 27:
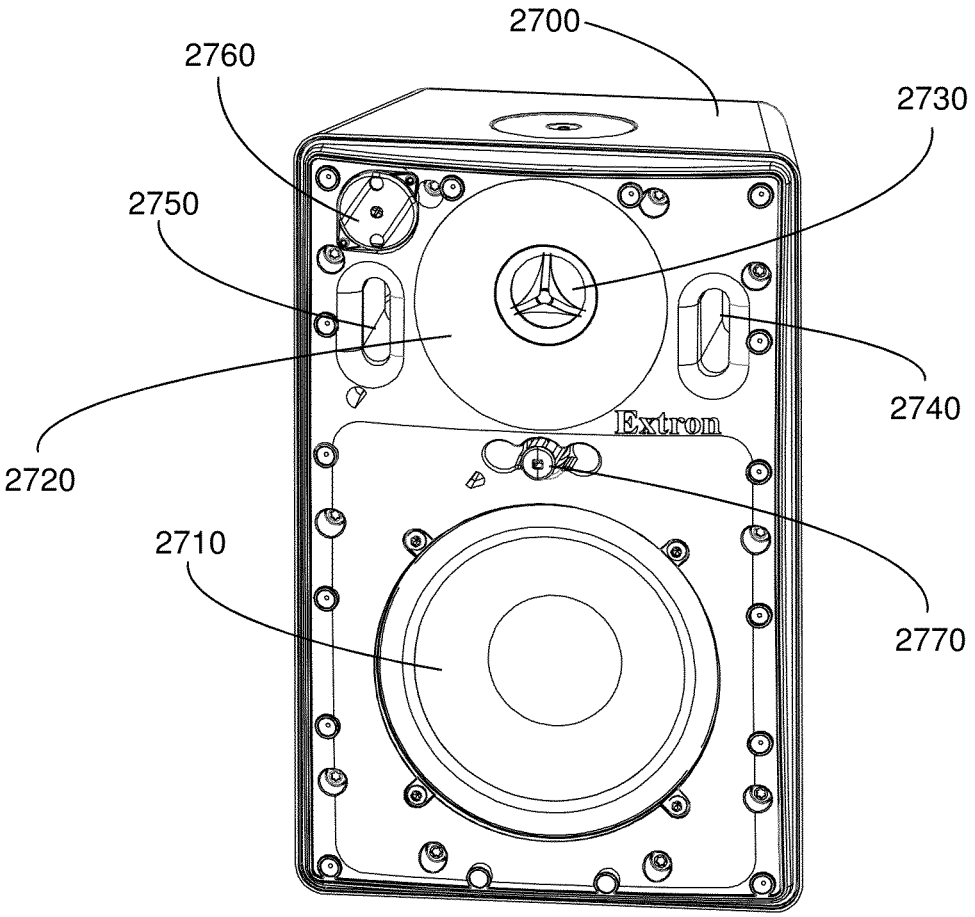
FIG. 27 is a perspective view of an embodiment of a loudspeaker of the present invention.

FIG. 27 shows a front view of an embodiment of a loudspeaker 2700 of the present invention without a front grille attached. Loudspeaker 2700 comprises a woofer 2710, a tweeter 2730, a round wave guide 2720, ports 2740 and 2750, switch assembly 2760, and a mount release button 2770.

Figure 28:
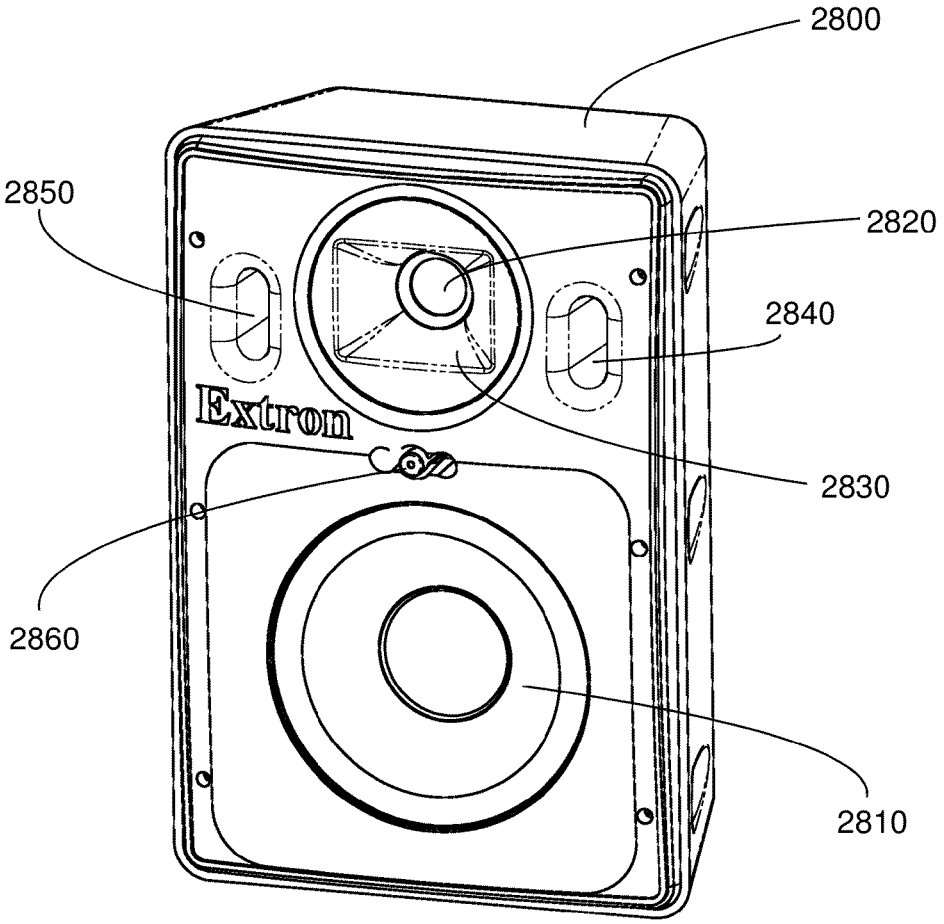
FIG. 28 is a perspective view of an embodiment of a loudspeaker of the present invention.

FIG. 28 shows a perspective view of an embodiment of a loudspeaker 2800 of the present invention without a front grille attached. Loudspeaker 2800 comprises a woofer 2810, a tweeter 2820, a rectangular wave guide 2830, ports 2840 and 2850 and a mount release button 2860. In the orientation of FIG. 28, loudspeaker 2800 has a wider dimension in a vertical direction and a narrower dimension in a horizontal direction.

Figure 29:
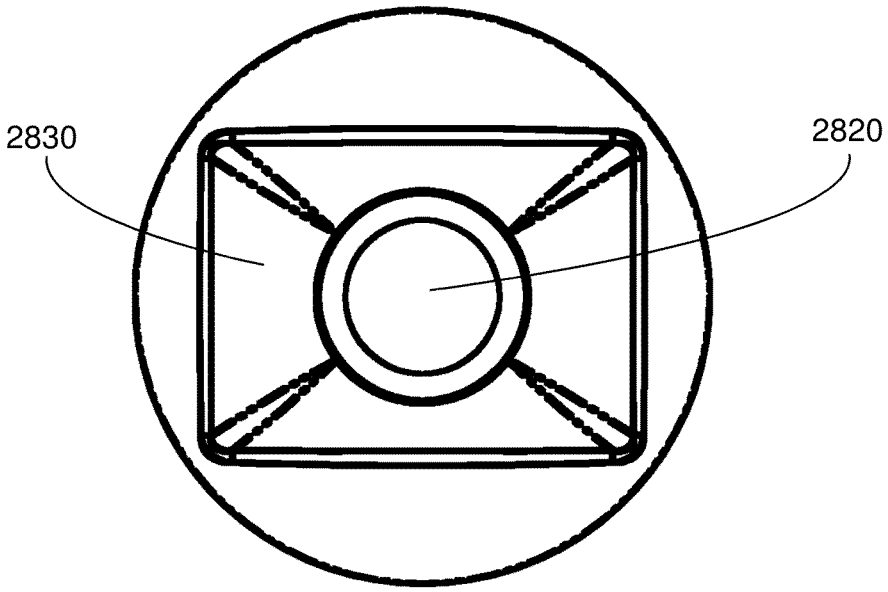
FIG. 29 is a front view of an embodiment of a waveguide of the present invention.

FIG. 29 shows a detail view of tweeter 2820 and rectangular wave guide 2830. In the orientation of FIG. 29, wave guide 2830 has a wider dimension in a horizontal direction and a narrower dimension in a vertical direction. In the orientation shown in FIG. 29, wave guide 2830 has a dispersion pattern that has a narrower dispersion angle in a vertical direction and a wider dispersion angle in a horizontal direction. In one or more embodiments, wave guide 2830 is rotatable to allow the orientation of the dispersion pattern to be changed.

Figure 30:
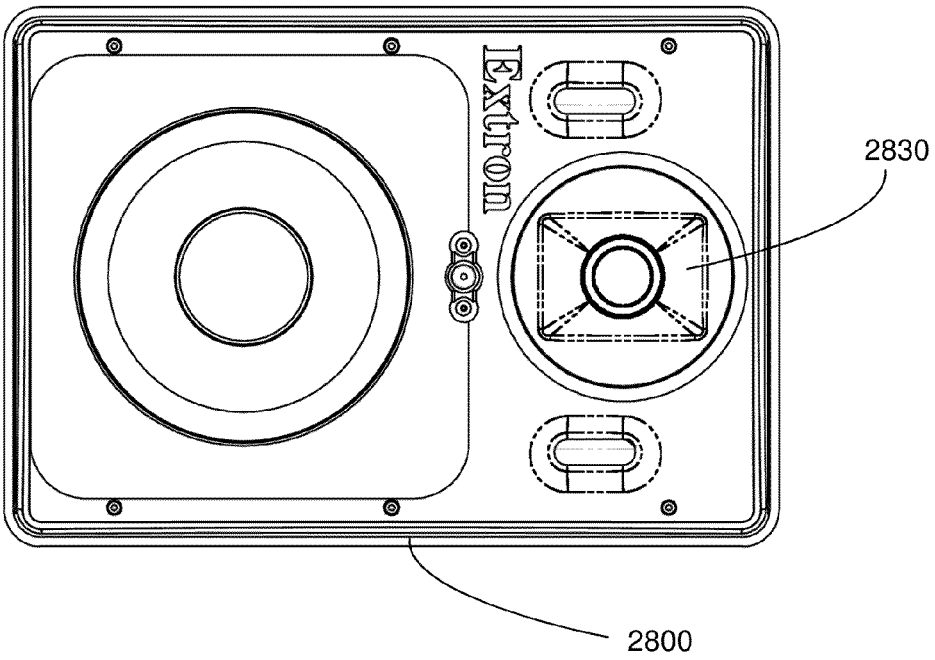
FIG. 30 is a front view of an embodiment of a loudspeaker of the present invention at a first orientation.

FIG. 30 shows loudspeaker 2800 oriented such that its wider dimension lies in a horizontal direction and its narrower direction lies in a vertical direction. Wave guide 2830 is also oriented such that its wider dimension lies in a horizontal direction and its narrower direction lies in a vertical direction. The dispersion pattern for the orientation of wave guide 2830 in FIG. 30 is such that there is a wider dispersion in the horizontal direction than in the vertical direction. This dispersion pattern is beneficial, for example, if loudspeaker 2800 is mounted in the orientation of FIG. 30 on a wall near a ceiling so that reflections from the ceiling are reduced.

Figure 31:
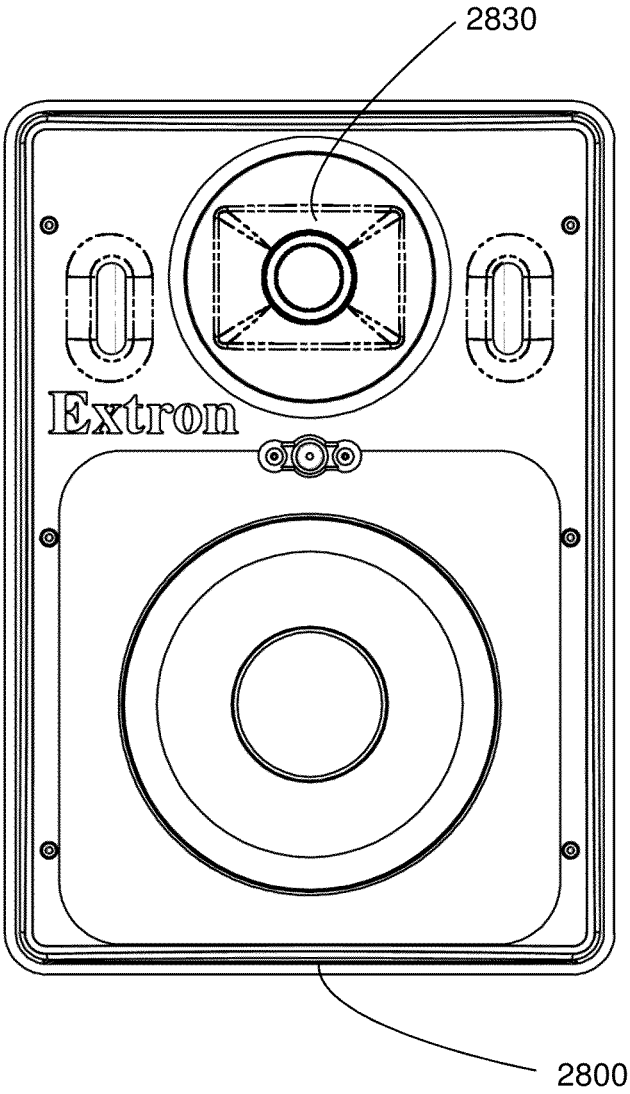
FIG. 31 is a front view of an embodiment of a loudspeaker of the present invention at a second orientation.

FIG. 31 shows loudspeaker 2800 oriented such that its wider dimension lies in a vertical direction and its narrower direction lies in a horizontal direction. Wave guide 2830, however, has been rotated from its orientation in FIG. 30 so that it is again oriented such that its wider dimension lies in a horizontal direction and its narrower direction lies in a vertical direction. The dispersion pattern for the orientation of wave guide 2830 in FIG. 31 is such that there is a wider dispersion in the horizontal direction than in the vertical direction. This dispersion pattern is beneficial, for example, if loudspeaker 2800 is mounted in the orientation of FIG. 31 on a wall near a ceiling so that reflections from the ceiling are reduced.

Figure 32:
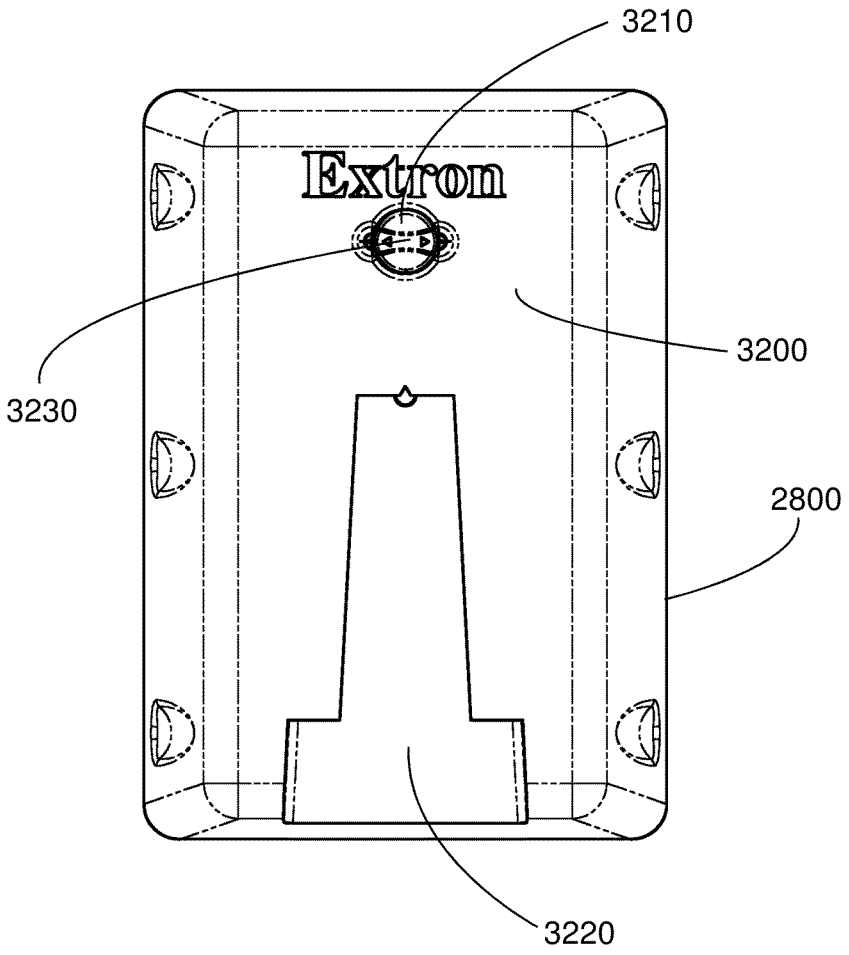
FIG. 32 is a rear view of an embodiment of a loudspeaker of the present invention at a first orientation.

FIG. 32 is a rear view of loudspeaker 2800 oriented in the same manner as in FIG. 31. In the embodiment of FIG. 32, the rear side 3200 of loundspeaker 2800 includes a tweeter orientation control 3210 which can be rotated to change the orientation of waveguide 2830. In the embodiment of FIG. 32, orientation control 3210 comprises a knob with an indicator 3230 that indicates the orientation of waveguide 2830. In the embodiment of FIG. 32, indicator 3230 indicates that waveguide 2830 is oriented with its wider dimension in a horizontal direction, corresponding to the orientation shown in FIG. 31. In the embodiment of FIG. 31, rear side 3200 includes a mounting channel 3220 similar to mounting channel 200 of the embodiment of FIG. 4.

Figure 33:
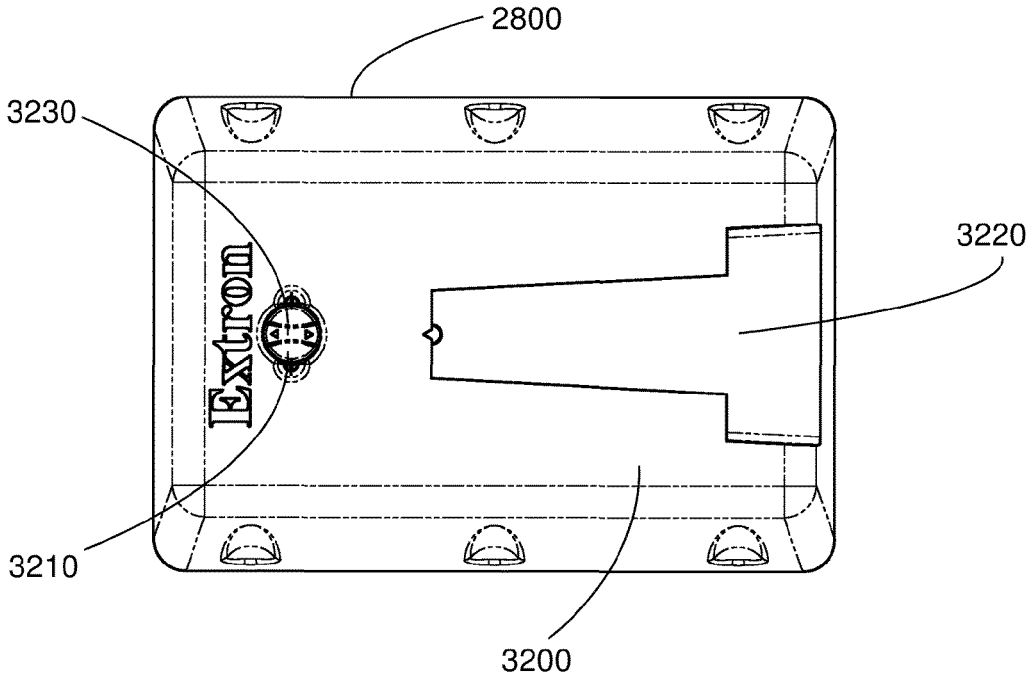
FIG. 33 is a rear view of an embodiment of a loudspeaker of the present invention at a second orientation.

FIG. 33 is a rear view of loudspeaker 2800 oriented in the same manner as in FIG. 30. In the embodiment of FIG. 33, the orientation of waveguide 2830 has been rotated 90 degrees from the orientation of FIG. 32 by rotation of orientation control 3210. In the embodiment of FIG. 33, indicator 3230 indicates that waveguide 2830 is oriented with its wider dimension in a horizontal direction, corresponding to the orientation shown in FIG. 30.

Figure 34:
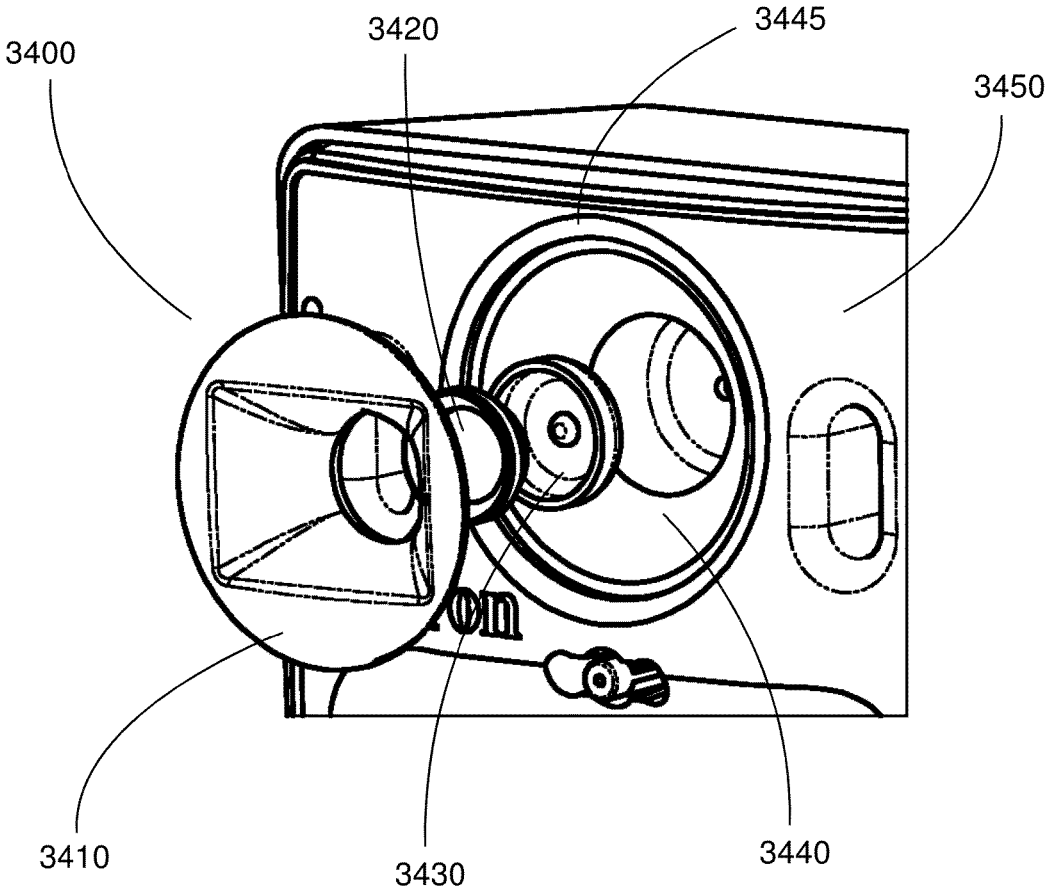
FIG. 34 is a perspective view of an embodiment of a waveguide of the present invention.

FIG. 34 is an exploded view showing components of a rotatable waveguide assembly 3400 of an embodiment the present invention. The components shown in FIG. 34 include waveguide 3410, tweeter 3420 and rear tweeter housing 3430. The embodiment of FIG. 34 also includes a recessed chamber 3440 formed the front of loudspeaker housing 3450 into which rotatable waveguide assembly 3400 is recessed when assembled. In the embodiment of FIG. 34, chamber 3440 includes a lip 3445 which mates with the back of waveguide 3410. In one or more embodiments, chamber 3440 is sealed off from the interior of loudspeaker housing 3450 to prevent sound waves generated by tweeter 3420 from entering the interior of loudspeaker housing 3450.

Figure 35:
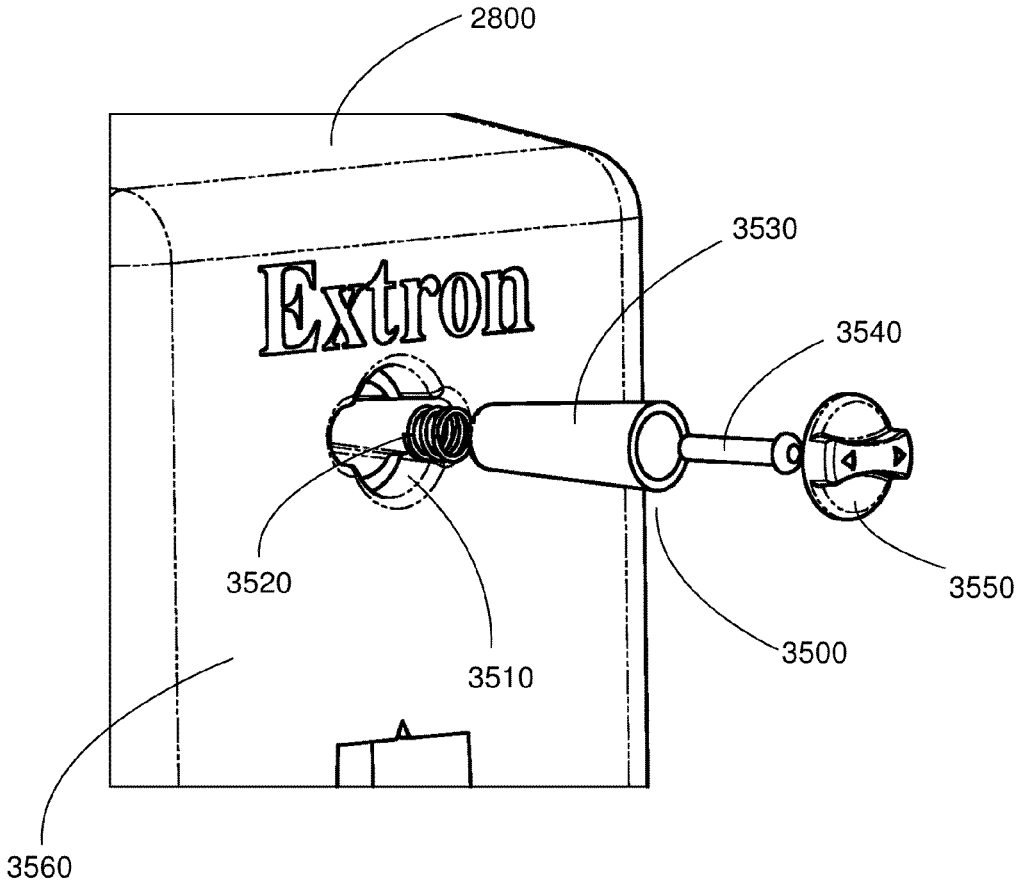
FIG. 35 is a perspective view of an embodiment of a speaker orientation assembly of the present invention.

FIG. 35 is an exploded view showing components of a waveguide orientation control assembly 3500 of an embodiment of the present invention. In one or more embodiments, waveguide orientation control assembly 3500 is attached to rotatable waveguide assembly 3400 of FIG. 34 and is used to change the orientation of rotatable waveguide assembly 3400.

In the embodiment of FIG. 35, orientation control assembly 3500 includes a compression spring 3520, a tapered ferule 3530, a connecting pin 3540, and a knob 3550. The embodiment of FIG. 35 also includes a recessed chamber 3510 in rear loudspeaker housing 3560 into which control assembly 3500 is recessed when assembled. In one or more embodiments, chamber 3510 is sealed off from the interior of loudspeaker 2800.

Figure 36:
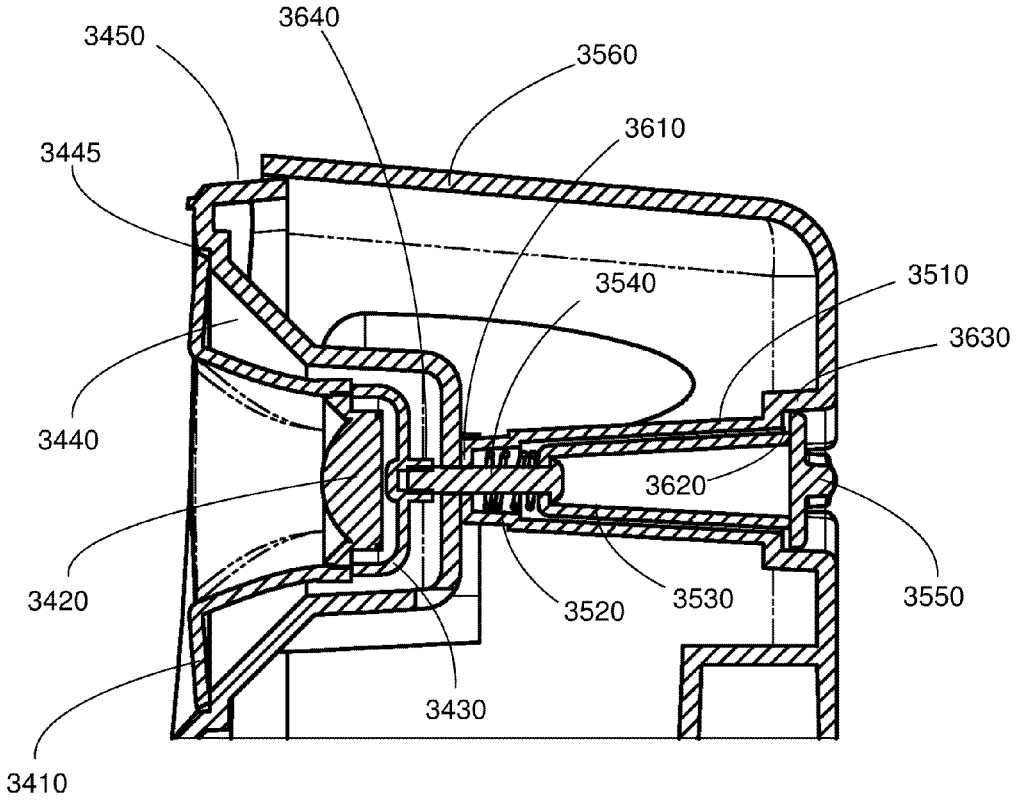
FIG. 36 is a sectional view of an embodiment of a speaker orientation assembly of the present invention.

FIG. 36 is a cross sectional view showing how the rotatable waveguide assembly 3400 of FIG. 34 and orientation control assembly 3500 of FIG. 35 are mounted in loudspeaker 2800 in one or more embodiments of the invention. In the embodiment of FIG. 36, tweeter 3420 is mounted to waveguide 3410 and rear tweeter housing 3430 and the resulting assembly is recessed into recessed chamber 3440 in front housing 3450. Orientation control knob 3550 is mounted to tapered ferrule 3530. Connecting pin 3540 connects tapered ferrule 3530 to rear tweeter housing 3430 through aligned holes the back surfaces of chambers 3440 and 3510. In one or more embodiments, connecting pin 3540 comprises a screw that screws into a flange 3640 formed on the back surface of rear tweeter housing 3430. Compression spring 3520 is disposed between tapered ferrule 3530 and back surface 3610 of chamber 3510 such that it exerts a bias against tapered ferrule 3530 to the right in the orientation of FIG. 36 that biases waveguide 3410 against lip 3445 of chamber 3440 and that provides clearance 3620 between control knob 3550 and lip 3630 of chamber 3510. In the embodiment of FIG. 36, to change the orientation of waveguide 3410, control knob 3550 is pushed to the left to compress compression spring 3520 and to disengage waveguide 3410 from lip 3445 of chamber 3440. Control knob 3550 is then rotated, thereby rotating waveguide 3410, until the desired orientation is reached. Control knob 3550 is then released, which allows compression spring 3520 to once again bias waveguide 3410 against lip 3445, whereby chamber 3440 forms a sealed chamber around the back of the assembly comprising waveguide 3410, tweeter 3420, and rear tweeter housing 3430.

Figure 37:
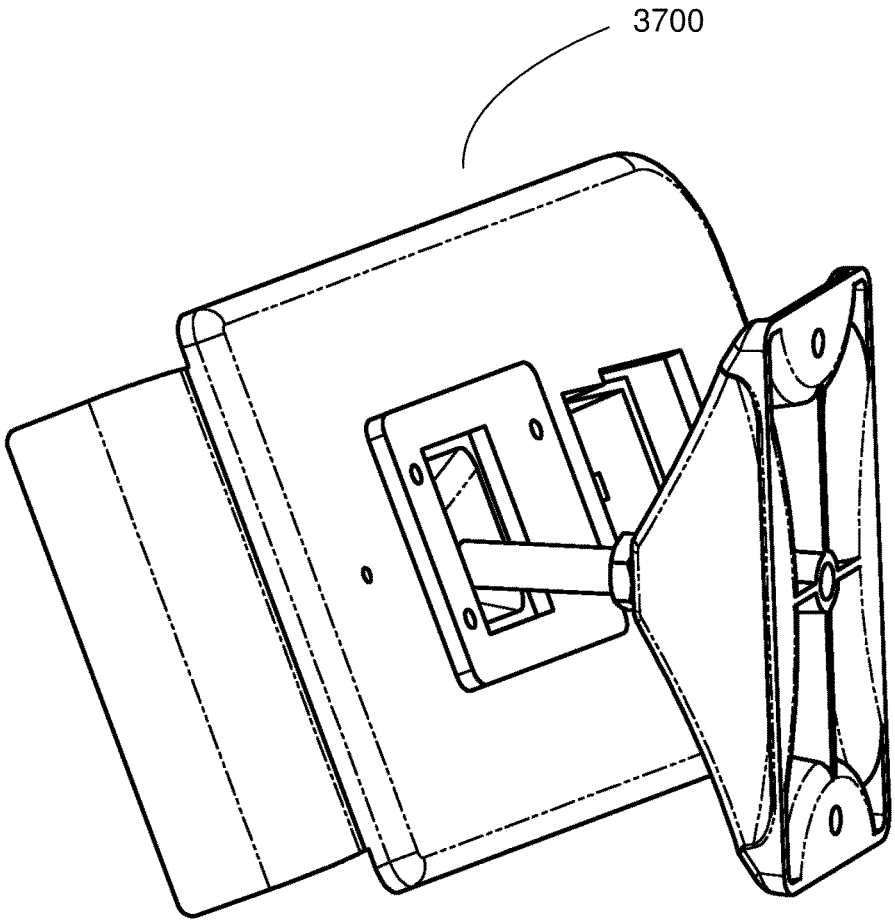
FIG. 37 is a perspective view of an embodiment of a speaker mount of the present invention.
Figure 38:
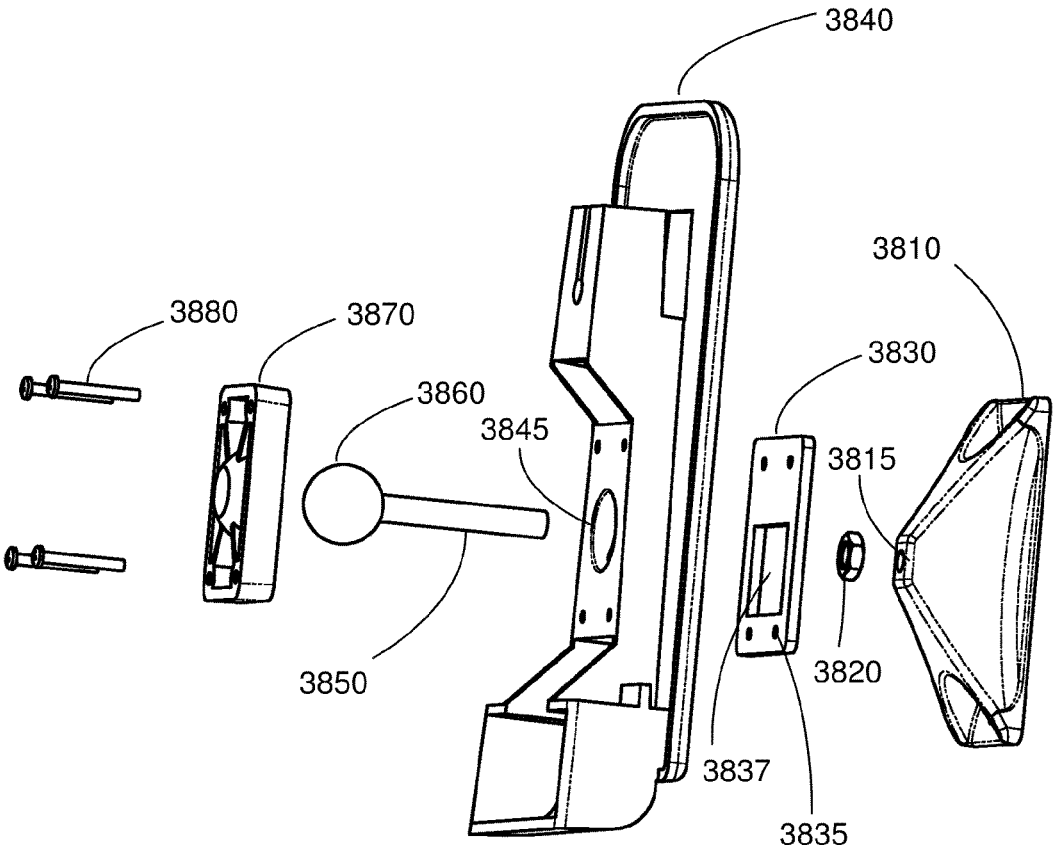
FIG. 38 is an exploded view of an embodiment of a speaker mount of the present invention.

FIGS. 37 and 38 show a gimbaled speaker mount 3700 of an embodiment of the invention. As shown in FIG. 38, gimbled speaker mount 3700 includes a base 3810, a nut 3820, a rear plate 3830, a speaker mount bracket 3840, a rod 3850, a ball 3860, a front plate 3870, and fasteners 3880. In one or more embodiments, base 3810 is configured to be mountable upon a standard electrical box in a similar manner to speaker mount 800 of FIG. 8. In one or more embodiments, rod 3850 includes threads configured to engage nut 3820 and threaded hole 3815 of base 3810. In one or more embodiments rod 3850 comprises threads that engage a mating threaded hole in ball 3860. In one or more embodiments, gimbled speaker mount 3700 is assembled in the following manner. Rod 3850 is attached to ball 3860, for example by screwing rod 3850 into a threaded hole in ball 3860 or any other suitable manner. Rod 3850 is inserted through orifice 3845 of mount bracket 3840 and opening 3837 in rear plate 3830. In one or more embodiments, orifice 3845 has a diameter less than the diameter of ball 3860. Nut 3820 is threaded onto rod 3850, and then rod 3850 is threaded into threaded hole 3815 of base 3810. In one or more embodiments, rod 3850 contains threads along all or most of its length, so that the length that it extends from base 3810 is adjusted by the degree to which rod 3810 is threaded into threaded hole 3815. In one or more embodiments, nut 3820 acts as a jam nut that is tightened to base 3810 once the desired protrusion length of rod 3810 is obtained.

In one or more embodiments, once rod 3850 is mounted to base 3810, fasteners 3880 are used to clamp ball 3860 between rear plate 3870 and orifice 3845 of mount bracket 3840 by engaging threaded holes 3835 of rear plate 3830, forming a ball and socket joint that allows adjustment of the orientation of mount bracket 3840 with respect to base 3810. Once the desired orientation of mount bracket 3840 is achieved, fasteners 3880 may be tightened to prevent further movement of mount bracket 3840 with respect to base 3810.

Figure 39:
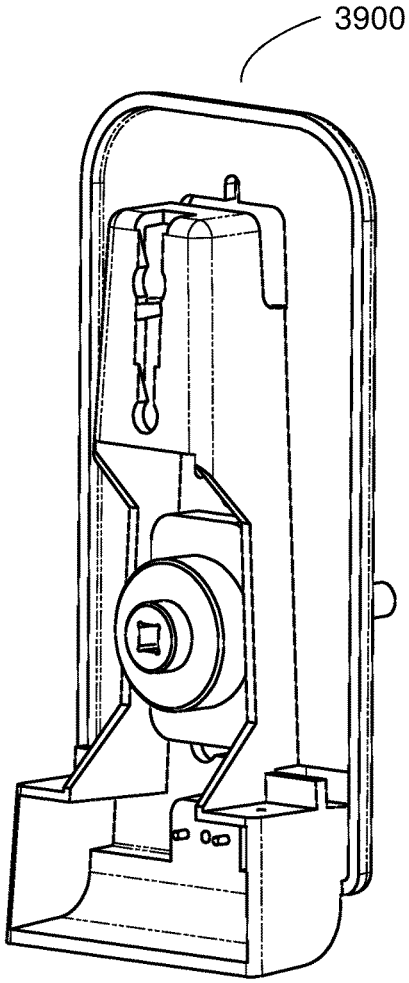
FIG. 39 is perspective view of an embodiment of a speaker mount of the present invention.
Figure 40:
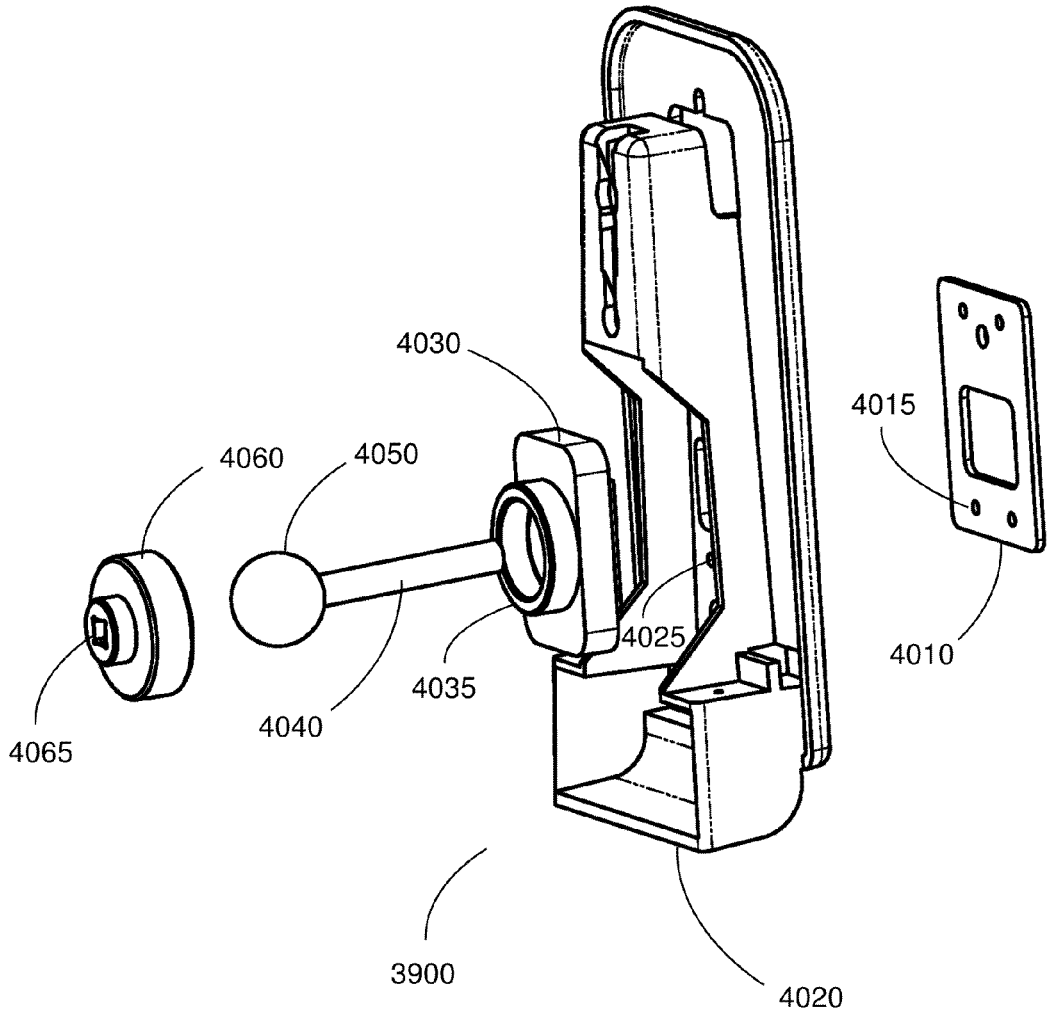
FIG. 40 is an exploded view of an embodiment of a speaker mount of the present invention.

FIGS. 39 and 40 show an alternative embodiment 3900 of a gimbaled speaker mount of the present invention. As shown in FIG. 40, speaker mount 3900 includes a rear plate 4010, a mount bracket 4020, a front plate 4030, rod 4040, ball 4050, and cap 4060. Rod 4040 and ball 4050 assemble together in the same manner as ball 3860 and rod 3850 of the embodiment of FIGS. 37 and 38, and rod 4040 is configured to attach to base 3810 of FIG. 38 in the same manner as rod 3850. Rear plate 4010 and front plate 4030 are assembled so that they sandwich mount bracket 4020 between them, for example using screws that pass through matching holes 4015 and 4025 in rear plate 4010 and mount bracket 4020, respectively, and are threaded into threaded holes (not shown) on the rear side of front plate 4030. Front plate 4030 comprises a protrusion 4035 that, in one or more embodiments, has an internal diameter less than the diameter of ball 4050 and external threads that are configured to mate with internal threads of cap 4060. In one or more embodiments, cap 4060 and protrusion 4035 are configured such that cap 4060 can be screwed onto protrusion 4035 to clamp ball 4050 between them, holding mount bracket 4020 in the desired orientation with respect to ball 4050. In one or more embodiments, cap 4060 includes a drive slot 4065 that allows cap 4060 to be turned with a screwdriver or other tool.

Figure 41:
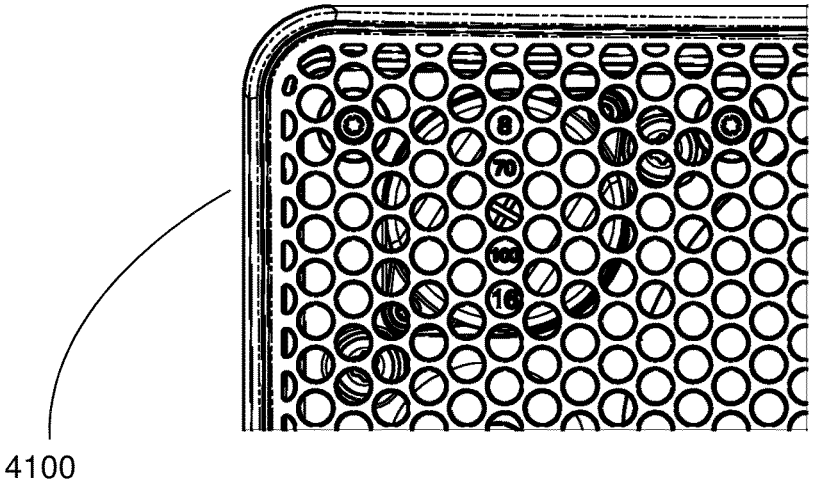
FIG. 41 is a front view of an embodiment of a switch assembly of a loudspeaker of the present invention.
Figure 42:
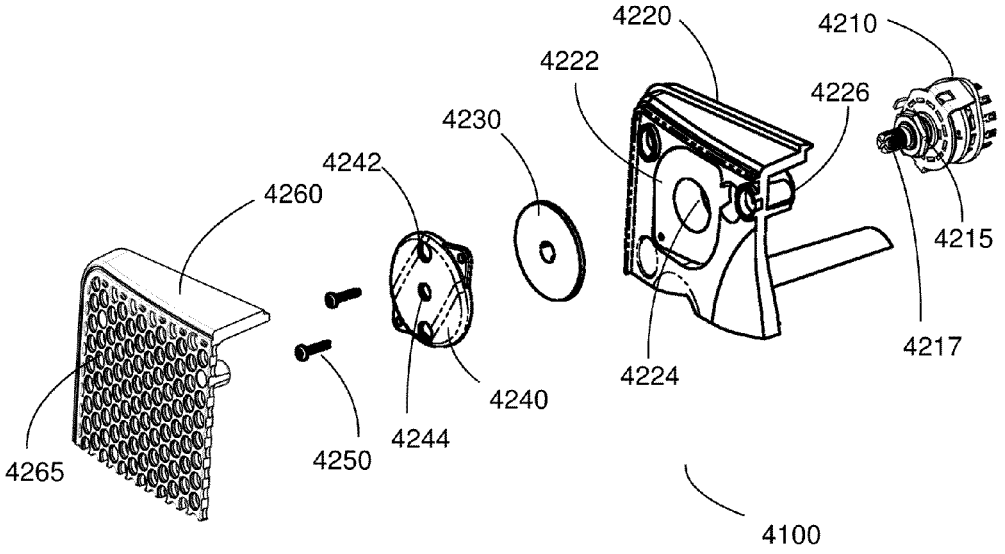
FIG. 42 is an explolded view of an embodiment of a switch assembly of a loudspeaker of the present invention.
Figure 43:
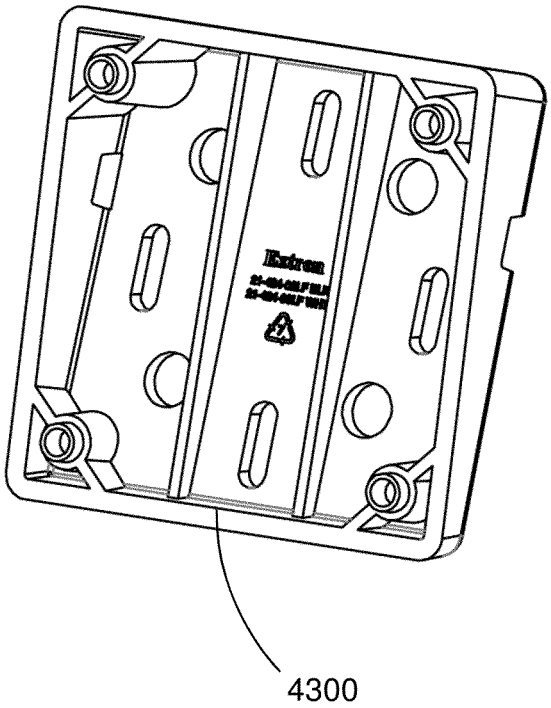
FIG. 43 is a perspective view of an embodiment of a speaker mount adapter of the present invention.

FIGS. 41 and 42 show an embodiment of a switch assembly 4100 of the present invention. Referring to FIG. 42, switch assembly 4100 allows the operation of a switch 4210 through perforations 4265 of a grille 4260 using a screwdriver or other tool. In the embodiment of FIGS. 41 and 42, switch assembly 4100 includes a switch 4210, a speaker housing wall 4220, a dial indicator 4230, a dial cover 4240, fasteners 4250 and grille 4260. In one or more embodiments, speaker housing wall 4220 includes an integrally formed switch assembly mount location 4222. In one or more embodiments, switch 4210 is mounted to a rear protrusion 4226 of mount location 4222 in a conventional manner, for example with a shaft nut 4215 such that shaft 4217 of switch 4210 extends into and slightly beyond a recessed bore 4224 of mount location 4222. In one or more embodiments, dial indicator 4230 is placed onto the end of shaft 4217 that extends through recessed bore 4224 such that dial indicator 4230 rotates together with shaft 4217. In one or more embodiments, dial indicator 4230 is marked with indicia that identify different switch positions of switch 4210. In one or more embodiments, dial cover 4240 is attached to mount location 4222 using fasteners 4250 such that dial cover 4240 is maintained in a fixed position with respect to speaker housing wall 4220. In one or more embodiments, dial cover 4240 has openings 4242 through which the indicia of dial indicator 4230 are visible, and a central opening 4244 through which a tool can be inserted to engage and rotate shaft 4217 of switch 4210. In one or more embodiments, the positions of openings 4240 and central opening 4244 are configured such that they align with perforation holes 4265 of grille 4260 when grille 4260 is assembled to speaker housing wall 4220.

Figure 8:
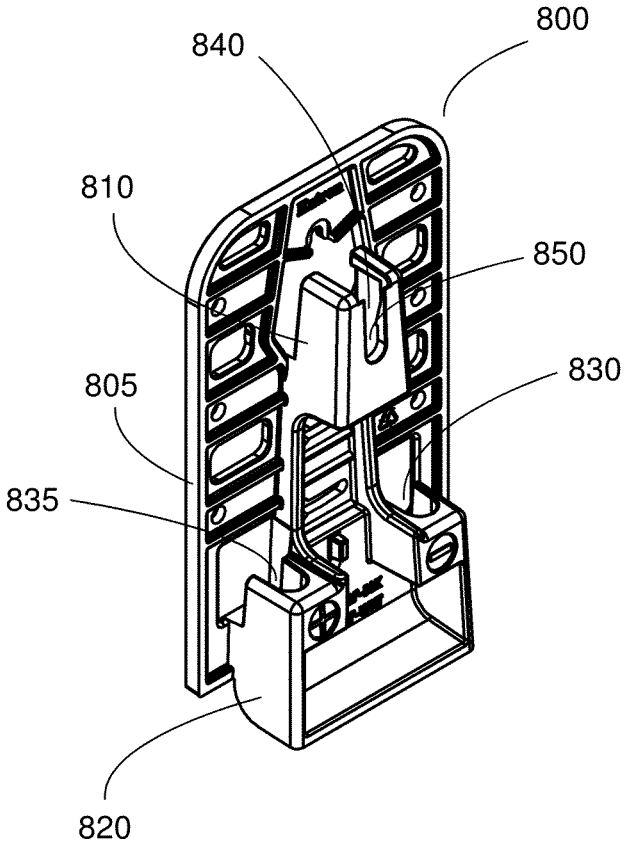
FIG. 8 is a perspective view of an embodiment of a speaker mount of the present invention.
Figure 44:
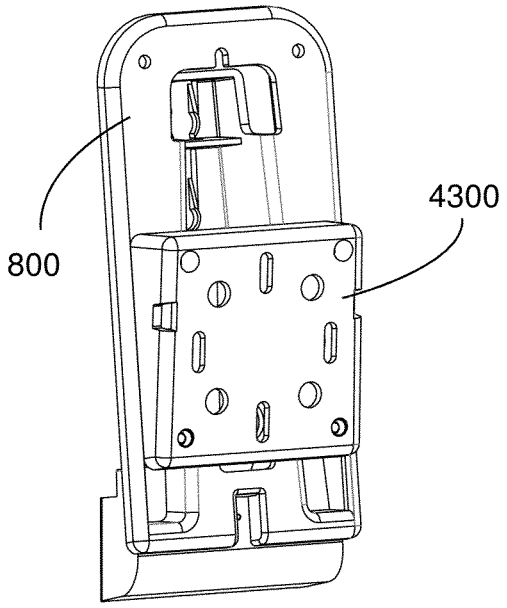
FIG. 44 is a perspective view of an embodiment of a speaker mount and speaker mount adapter of the present invention.
Figure 45:
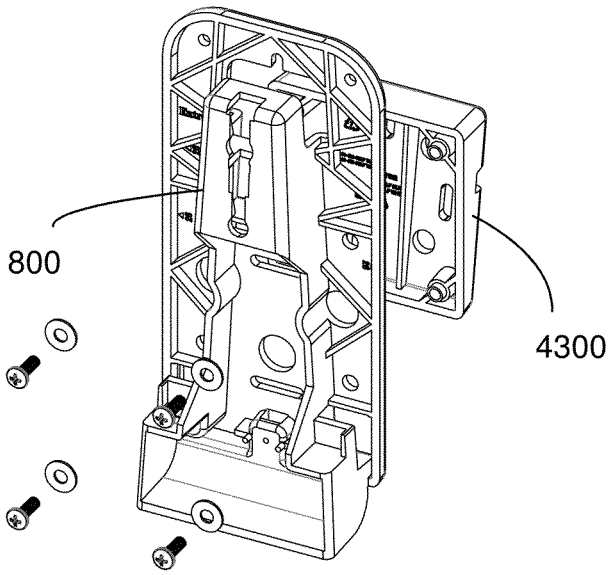
FIG. 45 is an exploded view of an embodiment of a speaker mount and speaker mount adapter of the present invention at a first orientation.
Figure 46:
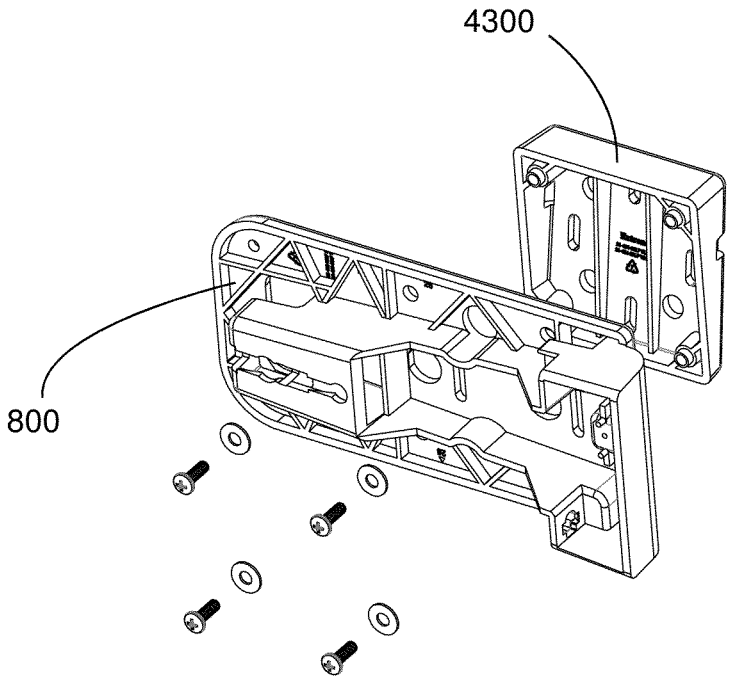
FIG. 46 is an exploded view of an embodiment of a speaker mount and speaker mount adapter of the present invention at a second orientation.

FIGS. 43 to 46 show a wedge 4300 that can be used with speaker mount 800 of FIG. 8 to change the angle of at which a speaker is mountable to speaker mount 800. As shown in FIGS. 44 to 46, in the embodiment of FIGS. 43 to 46, wedge 4300 is configured such that it is attachable to speaker mount 800 whether speaker mount 800 is used in vertical or horizontal orientations.

Thus, a novel loudspeaker system comprising a loudspeaker and mating speaker mounts has been disclosed. Besides offering a more convenient manner to mount and wire surface mount speakers, the present invention allows division of the installation process into tasks that are easily allocated among conventional divisions of trade between, for example, a building contractor and an AV ("audio video") installer. For example, the contractor is commonly responsible for installing in-wall wiring and junction boxes, while the AV installer is responsible for installing the speakers thermselves, as well as making electrical connections to the speaker. In an example installation process, the contractor would run the wires through the wall to a junction box affixed to a wall stud and create an appropriate opening in the wall surface (i.e. drywall) adjacent to the junction box. The AV installer would attach the speaker mount to the junction box, connect the in-wall wires to the speaker mount electrical connectors, and mount the speaker on the mount.

Although the present invention has been described with respect to certain specific embodiments, it will be clear to those skilled in the art that the inventive features of the present invention are applicable to other embodiments as well, all of which are intended to fall within the scope of the present invention. For example, although specific configurations of a loudspeaker have been disclosed, it will be understood that the invention is not limited to any particular size, shape, capacity, or type of loudspeaker. Further, although speaker mounts have been described that are configured to be mountable to a surface such as a wall or to an electrical junction box, speaker mounts incorporating the inventive features of the invention can be configured to be free standing or to mount to any type of surface, item, or object, and can be configured to provide electrical connections, including in-wall, exposed, and wireless connections to any type of audio source, including portable or mobile devices. In addition to or instead of providing electrical connections for audio signals, the mating mounting structures of the loudspeaker and speaker mount can provide additional and/or other types of electrical connections, such as, for example, power or network communications connections. Although embodiments have been described in which one speaker mount is used to mount one loudspeaker, for large loudspeakers, more than one speaker mounts may be used for a single loudspeaker. Although embodiments of the loudspeaker and speaker mount of the invention have been described as each having one mounting structure, the loudspeaker and speaker mounts can each have multiple mounting structures that allow attachment to the other at different positions or orientations. Although the mating mounting structures of the present invention have been described as being used for loudspeaker systems, other types of objects may use the mating mounting structures of the invention. Although particular configurations for the mating mounting structures for a loudspeaker and a speaker mount have been described, any other configuration can be used that provides a positive engagement of the loudspeaker with the speaker mount and that provides an electrical connection between the loudspeaker and the speaker mount when the loudspeaker is engaged with the speaker mount. Also, although a particular configuration of a "hidden" locking mechanism has been disclosed, any other configurations as will be apparent to those skilled in the art can be used.

The invention claimed is:

1. A loudspeaker system comprising a loudspeaker and a speaker mount, said loudspeaker and speaker mount configured to support said loudspeaker at a variety of orientations, said loudspeaker comprising a speaker housing, said speaker housing comprising a rotatable waveguide assembly configured to adjust a dispersion of sound from said waveguide assembly to conform to said variety of orientations, said rotatable waveguide assembly comprising a waveguide at a first side of said speaker housing and a control configured to adjust an orientation of said waveguide at a second side of said speaker housing.

2. The loudspeaker system of claim 1 wherein said rotatable waveguide assembly comprises a tweeter.

3. The loudspeaker system of claim 1 wherein said control is configured to bias said waveguide towards said first side of said speaker housing.

4. The loudspeaker system of claim 3 wherein said control comprises a compression spring configured to bias said waveguide towards said first side of said speaker housing.

5. The loudspeaker system of claim 4 wherein said control comprises a knob configured to compress said compression spring and rotate said waveguide.

6. The loudspeaker system of claim 1 wherein said speaker mount comprises a gimbal assembly configured to attach said speaker mount to a support structure.

7. The loudspeaker system of claim 6 wherein said gimbal assembly comprises a base configured to attach to said support structure.

8. The loudspeaker system of claim 7 wherein said gimbal assembly comprises a ball and socket assembly.

9. The loudspeaker system of claim 8 wherein said ball and socket assembly comprises a threaded rod engageable with a threaded hole in said base.

* * * * *